US006193346B1

(12) United States Patent
Nakano

(10) Patent No.: US 6,193,346 B1
(45) Date of Patent: Feb. 27, 2001

(54) INK-JET RECORDING APPARATUS

(75) Inventor: Tomoaki Nakano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/116,700

(22) Filed: Jul. 16, 1998

(30) Foreign Application Priority Data

Jul. 22, 1997 (JP) ..... 9-195337
Jul. 22, 1997 (JP) ..... 9-195338
May 19, 1998 (JP) ..... 10-135808

(51) Int. Cl.[7] ..... B41J 2/015
(52) U.S. Cl. ..... 347/12
(58) Field of Search ..... 347/12, 14, 13, 347/57, 180, 181, 182, 9, 11, 15

(56) References Cited

U.S. PATENT DOCUMENTS 5,754,193 * 5/1998 Elhatem ..... 347/12

FOREIGN PATENT DOCUMENTS 57-160654 10/1982 (JP) .
57 160 654 * 10/1982 (JP) ..... 347/12
58-62063 4/1983 (JP) .
6-8428 1/1994 (JP) .

* cited by examiner

*Primary Examiner*—John Barlow
*Assistant Examiner*—Charles W. Stewart, Jr.
(74) *Attorney, Agent, or Firm*—Cooper & Dunham LLP

(57) ABSTRACT

A plurality of pressure-application ink chambers communicate with a plurality of nozzles, respectively. A plurality of energy generating elements generate energy for applying pressure to ink in the plurality of pressure-application ink chambers so as to cause ink drops to be fired from the plurality of nozzles, respectively. A driving-waveform generating portion generates a plurality of driving waveforms for driving the plurality of energy generating elements. A driving-waveform selecting portion selects one of the plurality of driving waveforms generated by the driving-waveform generating portion for each one of the plurality of energy generating elements in accordance with image information.

16 Claims, 23 Drawing Sheets

32-BIT CLOCK SIGNAL
32-BIT NOZZLE DATA
32-BIT NOZZLE DATA
tr = tr2
tr = tr2
VpA
VpB
FIG. 12A SCLK
FIG. 12B DiA
FIG. 12C DiB
FIG. 12D /LAT
FIG. 12E MM
FIG. 12F SAi
FIG. 12G SBi
FIG. 12H Do1
FIG. 12I Do2
FIG. 12J Do32

INK FIRING AMOUNT Mj
Tr=tr2
MAXIMUM DRIVING VOLTAGE Vp

INK FIRING SPEED Vj
tr=tr2
UNSTABLE RANGE
STABLE RANGE
UNSTABLE RANGE
VjH
VjL
Vp1
Vp3
MAXIMUM DRIVING VOLTAGE Vp

CARRIAGE SCANNING AND PRINTING DIRECTION

INK FIRING SPEED Vj
Vp=Vp1
Vp=Vp3
Vj2
VjS
Vj1
tr1
tr2
tr3
RISING TIME CONSTANT tr

32-BIT SHIFT REGISTER CIRCUIT
32-BIT SHIFT REGISTER CIRCUIT
32-BIT SHIFT REGISTER CIRCUIT
96-BIT LATCH CIRCUIT
96-BIT LATCH SHIFTER CIRCUIT
111A
111B
111C
112'
113'
114''
Vpp
SCLK
DiA
DiB
DiC
/LAT
SAi
SBi
SCi
ASA 32
ASB 32
ASC 32
ASA 1
ASB 1
ASC 1
Do 32
Do 2
Do 1

INK-JET RECORDING APPARATUS

BACKGROUND OF THE INVENTION

1. Field of the Invention

The present invention relates to an ink-jet recording apparatus. In particular, the present invention relates to an ink-jet recording apparatus which can record a multi-tone image. Further, the present invention relates to an ink-jet recording apparatus in which a driving waveform is applied to non-firing nozzles such that the nozzles do not fire ink thereby.

2. Description of the Related Art

An ink-jet recording apparatus which can be used as an image forming apparatus of a printer, a facsimile machine, a copier or the like is disclosed in Japanese Laid-Open Patent Application No.57-160654, for example. In this ink-jet recording apparatus, variations in diameters of dots can be corrected and/or a multi-tone image can be recorded, as a result of controlling a driving waveform so as to change an ink-firing amount or a dot diameter. In this ink-jet recording apparatus, appropriate pulses are selected from a series of a plurality of voltage pulses, the thus-selected pulses are used for driving an electromechanical transducing device, a plurality of ink drops, the speeds and diameters of which are different from each other, are fired from a nozzle, the thus-fired plurality of ink drops are combined into a single ink drop while the ink drops are flying, the single ink drop hits on a recording medium, and thus, a dot is formed on the recording medium.

Further, Japanese Laid-Open Patent Application No.6-8428 discloses a driving method in which pulse signal outputting means for outputting a plurality of signals, having pulse widths different from each other, in synchronization with a driving signal, and signal selecting means for selecting one signal from the thus-output plurality of signals, are used. Then, the thus-selected signal is used for switching between turning on and turning off of piezoelectric-element driving means during an unsaturated region of the driving signal so that a voltage to be applied to the piezoelectric element is changed. Thus, an amount of an ink drop fired from each nozzle is caused to be fixed.

However, in a recording apparatus such as that disclosed in Japanese Laid-Open Patent Application No.57-160654, in a case where the number of nozzles of an ink-jet head is increased in response to high-integration and high-density in the recording apparatus, because a circuit for selecting pulses is needed for each nozzle, a scale of an entire driving circuit increases, the number of signal wires increases, and the cost therefor increases. Further, a speed of a carriage is increased due to increase in a recording speed, and a period for repetition of dot formation is shortened. As a result, it is difficult to cause successively fired ink drops to be combined to a single ink drop while the ink drops are flying.

Further, in a recording apparatus using a driving method such as that disclosed in Japanese Laid-Open Patent Application 6-8428, because the voltages applied to the piezoelectric elements vary due to variations in transistor-turning-off timings, it is not possible to control the voltages to be applied to the piezoelectric elements in high accuracy. Further, when a driving voltage is controlled, an amount of an ink drop can be increased as a result of increase in the voltage. However, a speed of the ink drop is also increased at the same time. As a result, a point at which the ink drop hits on a recording medium is shifted so that dot-position accuracy is degraded, and/or 'satellites' are formed so that image quality is degraded.

Further, in an ink-jet recording apparatus which can be used as an image forming apparatus of a printer, a facsimile machine, a copier or the like, when an ink drop is caused to be fired from a certain nozzle, meniscuses in adjacent nozzles, which are not caused to fire ink drops, respectively (such a nozzle that is not caused to fire an ink drop being referred to as a non-firing nozzle), are in unstable conditions as a result of being affected mechanically or affected by flowing of the ink in the ink-jet head. Thereby, a speed (ink firing speed) Vj of ink fired from the nozzle of the ink-jet head and/or an amount (ink-firing amount) Mj of ink fired from the nozzle of the ink-jet head vary, when each of the adjacent nozzles is then caused to fire an ink drop, and also, a condition in which an ink drop is not fired sufficiently occurs as a result of bubbles being drawn into the nozzle and contained in the ink in the inkjet head.

As a method for eliminating such problems, Japanese Laid-Open Patent Application No.58-62063 discloses a method. In this method, a head in which two pressure-application chambers (ink chambers) are provided so as to face one another is used. In this arrangement, when one pressure-application chamber has pressure applied thereto and thereby an ink drop is fired therefrom, the other pressure-application chamber also has pressure applied thereto but this pressure application is such that an ink drop is not fired thereby.

However, such a method as that disclosed in Japanese Laid-Open Patent Application No.58-62063 can be used only for an ink-jet head having two pressure-application chambers provided so as to face one another.

SUMMARY OF THE INVENTION

The present invention has been devised in consideration of the above-mentioned problems, and an object of the present invention is to provide an inkjet recording apparatus which can form a high-quality image as a result of stabilization of firing of ink drops.

An ink-jet recording apparatus, according to the present invention comprises:

- a plurality of nozzles for firing ink drops;
- a plurality of pressure-application ink chambers, communicating with the plurality of nozzles, respectively;
- a plurality of energy generating elements for generating energy for applying pressure to ink in the plurality of pressure-application ink chambers so as to cause ink drops to be fired from the plurality of nozzles, respectively;
- driving-waveform generating means for generating a plurality of driving waveforms for driving the plurality of energy generating elements; and
- driving-waveform selecting means for selecting one of the plurality of driving waveforms generated by the driving-waveform generating means for each one of the plurality of energy generating elements in accordance with image information.

In this arrangement, because a plurality of driving waveforms are generated for driving the plurality of energy generating elements, and one of the plurality of driving waveforms generated by the driving-waveform generating means is selected for each one of the plurality of energy generating elements in accordance with image information, it is possible to stably fire ink drops and to perform high-quality recording with a simple circuit arrangement. Thereby, it is possible to easily form a multi-tone image as a result of controlling diameters of dots, and to easily correct variations in diameters of dots.

The image information may be converted into serial nozzle data for selecting nozzles to be driven for each of the plurality of driving waveforms, the serial nozzle data being input to the driving-waveform selecting means.

In this arrangement, because the image information may be converted into serial nozzle data for selecting nozzles to be driven for each of the plurality of driving waveforms, and the driving waveforms are selected in accordance with the serial nozzle data, it is not necessary to specially provide an image information processing portion, and merely a simple circuit arrangement of the driving-waveform selecting means should be provided, when the driving-waveform selecting means is formed to be an IC which is to be loaded in an ink jet head, and, in the circuit arrangement, the number of signal lines for the serial nozzle data does not increase when the number of nozzles increases.

The serial nozzle data may comprise a number of serial nozzle data, the number being equal to or less than the number of the plurality of driving waveforms. Thereby, it is possible to reduce the number of signal lines for the serial data, and thus, to reduce the cost of the signal transmission portion.

The plurality of driving waveforms may be waveforms having, at least one of a maximum driving voltage, a time constant and a pulse width being different from each other. Thereby, it is possible to fire ink drops more stably, and to improve accuracy in dot positions.

An ink-jet recording apparatus, according to another aspect of the present invention, comprises:

a plurality of nozzles for firing ink drops;

a plurality of pressure-application ink chambers, communicating with said plurality of nozzles, respectively;

a plurality of energy generating elements for generating energy for applying pressure to ink in the plurality of pressure-application ink chambers so as to cause ink drops to be fired from said plurality of nozzles, respectively;

driving-waveform generating means for generating a plurality of driving waveforms for driving said plurality of energy generating elements, the plurality of driving waveforms including a driving waveform for causing nozzles of said plurality of nozzles to fire ink drops and a driving waveform for causing nozzles of said plurality of nozzles to fire no ink drops; and driving-waveform selecting means for selecting one of the plurality of driving waveforms generated by said driving-waveform generating means for each one of said plurality of energy generating elements in accordance with image information.

Because this arrangement includes the driving-waveform generating means for generating a plurality of driving waveforms for driving said plurality of energy generating elements, the plurality of driving waveforms including a driving waveform for causing nozzles of said plurality of nozzles to fire ink drops and a driving waveform for causing nozzles of said plurality of nozzles to fire no ink drops, and the driving-waveform selecting means for selecting one of the plurality of driving waveforms generated by said driving-waveform generating means for each one of said plurality of energy generating elements in accordance with image information, it is possible to stably fire ink drops and to perform high-quality image recording.

The image information may be converted into serial nozzle data for selecting nozzles to be driven for each of the plurality of driving waveforms, and the serial nozzle data is input to said driving-waveform selecting means.

In this arrangement, because the image information may be converted into serial nozzle data for selecting nozzles to be driven for each of the plurality of driving waveforms, and the driving waveforms are selected in accordance with the serial nozzle data, it is not necessary to specially provide an image information processing portion, and merely a simple circuit arrangement of the driving-waveform selecting means should be provided when the driving-waveform selecting means is formed to be an IC which is to be loaded in an ink jet head, and, in the circuit arrangement, the number of signal lines for the serial nozzle data does not increase when the number of nozzles increases.

The serial nozzle data may comprise a number of serial nozzle data, the number being equal to or less than the number of the plurality of driving waveforms, and the number of serial nozzle data including the serial nozzle data for selecting nozzles of said plurality of nozzles to be driven by the driving waveform but to fire no ink drops.

In this arrangement, because the number of serial nozzle data includes the serial nozzle data for selecting nozzles of said plurality of nozzles to be driven by the driving waveform but to fire no ink drops, and the serial nozzle data is produced in accordance with the image information, it is possible to use any pattern for determining nozzles of the plurality of nozzles to be driven by the driving waveform but to fire no ink drops (driven, non-firing nozzles). Therefore, it is possible to appropriately change the pattern in accordance with the head structure and/or the environment in which the ink-jet recording apparatus is used.

The plurality of driving waveforms may include the driving waveforms for causing nozzles of said plurality of nozzles to fire ink drops and for causing nozzles of said plurality of nozzles to fire no ink drops, the driving waveforms being waveforms having, at least one of a maximum driving voltage, a time constant and a pulse width thereof being different from each other.

In this arrangement, it is possible to apply appropriate driving waveforms to the ink-jet head even if the structure of the ink-jet head and/or the environment in which the ink-jet recording apparatus is used are/is changed. Thereby, it is possible to always stably fire ink drops and to perform high-quality image recording.

Other objects and further features of the present invention will become more apparent from the following detailed descriptions when read in conjunction with the accompanying drawings.

DETAILED DESCRIPTION OF THE PREFERRED EMBODIMENTS

Figure 1:
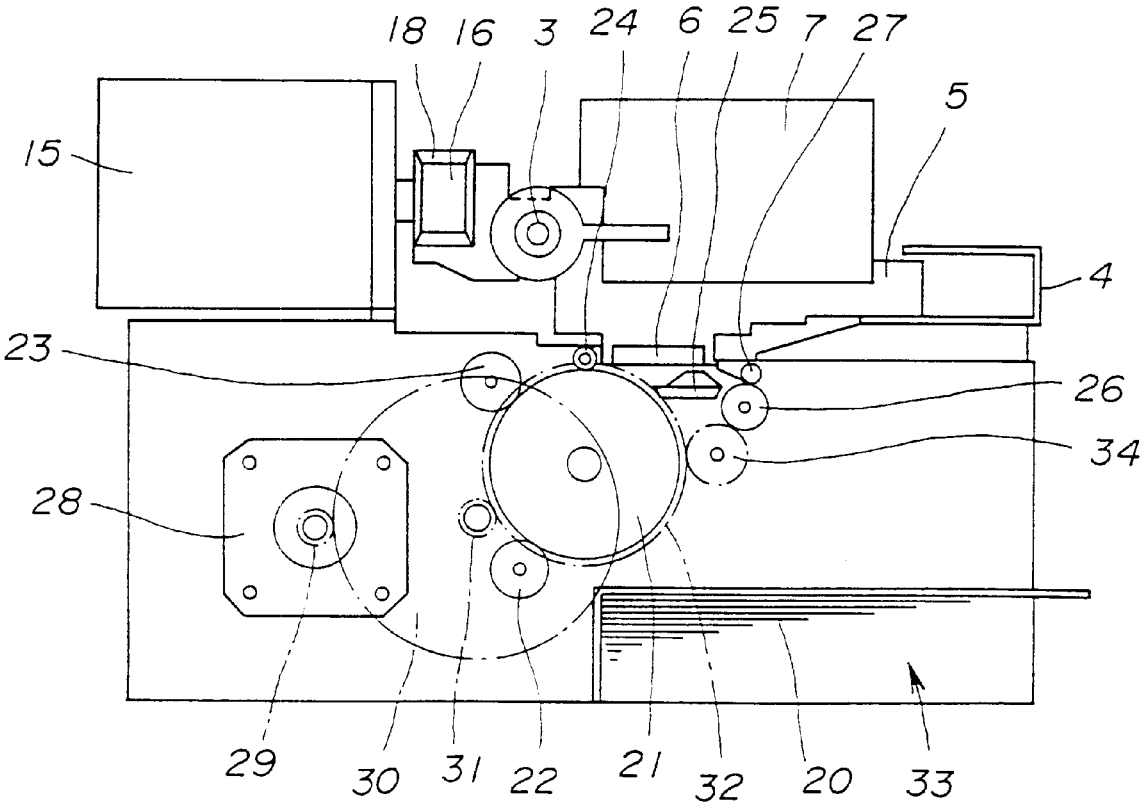
FIG. 1 shows a general arrangement of a mechanism of an ink-jet recording apparatus in a first embodiment of the present invention.
Figure 2:
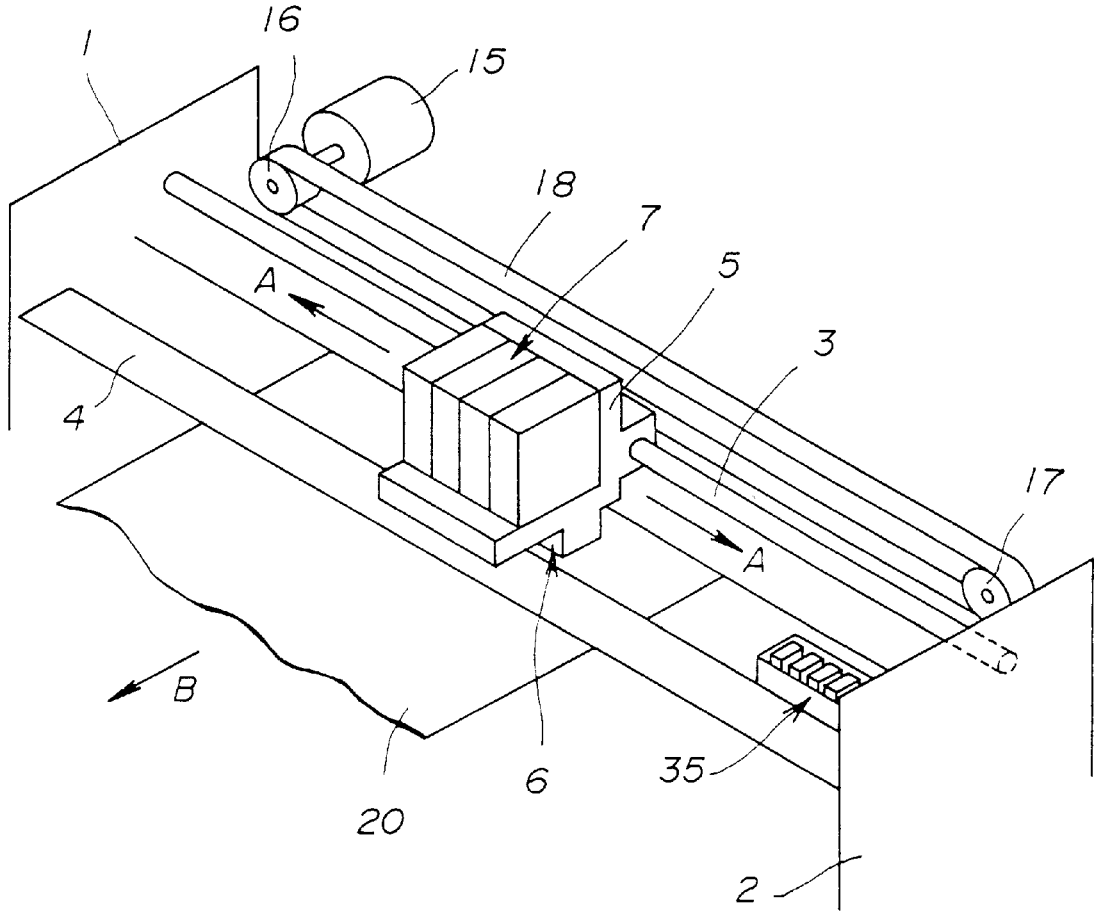
FIG. 2 shows a general partial perspective view of the ink-jet recording apparatus shown in FIG. 1.

A first embodiment of the present invention will now be described. FIG. 1 shows a general arrangement of a mechanism of an ink-jet recording apparatus in the first embodiment of the present invention. FIG. 2 shows a general partial perspective view of the ink-jet recording apparatus shown in FIG. 1.

In this ink-jet recording apparatus, a guide rod 3 and guide plate 4 each extending between left and right side walls 1 and 2 hold a carriage 5 slideable in main-scan directions A, A (see FIG. 2). A recording head 6 is loaded on a bottom surface of the carriage 5 in a manner in which an ink-drop firing direction of the recording head 6 is directed downward, the recording head 6 including ink-jet heads. Ink cartridges (ink tanks) 7 for supplying respective colors of ink to the recording head 6 are loaded on the top of the carriage 5.

The recording head 6 includes a head which fires yellow (Y) ink, a head which fires magenta (M) ink, a head which fires cyan (C) ink and a head which fires black (Bk) ink, these heads being arranged in the main-scan directions A, A.

The carriage 5 is connected with a timing belt 18 which is laid between a driving pulley 16 which is driven by a main-scan motor 15 which is a stepper motor, and a driven pulley 17. Thereby, the carriage 5 moves in the main-scan directions A, A, and thereby, the recording head 6 moves in the main-scan directions A, A, as a result of the main-scan motor 15 being rotated.

Further, the ink-jet recording apparatus includes (see FIG. 1), for a purpose of conveying paper 20 in a sub-scan direction B, a platen roller (hereinafter, simply referred to as a 'platen') 21, paper supply rollers 22, 23 and a pinch roller 24 which determines a paper-feeding angle, each being pressed onto the circumferential surface of the platen 21, a guide plate 25 which faces the recording head 6, a paper ejecting roller 26 disposed on a down-stream side, in the paper conveying direction, of the recording head 6, and a spur roller 27 for holding the paper, the spur roller 27 being pressed on to the paper ejecting roller 26.

A rotation of a sub-scan motor 28 which is a stepper motor is transmitted to the platen 21 through gears 29 through 31 and a platen gear 32, and thus the platen 21 is driven. Thereby, the paper 20 contained in a paper supply portion 33 is caused to pass the platen 21, paper supply rollers 22, 23 and pinch roller 24, then, is inserted between the recording head 6 and the guide plate 25, then is moved in the sub-scan direction B by the platen 21, and then is fed in the paper ejecting direction B (see FIG. 2) by the paper ejecting roller 26, which is rotated through a gear 34 engaged with the platen gear 32, and the spur roller 27.

In the recording apparatus having the above-described arrangement, the recording head 6 (together with the carriage 5) is moved in the main-scan directions A, A so as to scan the paper 20 while the paper 20 is conveyed in the sub-scan direction B. At the same time, ink drops of desired colors are fired from nozzles of each ink-jet head of the recording head 6. Thereby, a desired color image or a desired monochrome image is recorded on the paper 20.

Further, in this recording apparatus, a reliability maintaining and recovery mechanism (sub-system) 35 for the recording head 6 is disposed on the right side of a main-scan range of the carriage 5. When the recording apparatus is in a printing waiting condition, when printing data is not being transferred from a host during a predetermined time, or during a predetermined interval, the reliability maintaining and recovery mechanism 35 performs a reliability maintaining and recovery operation such as an operation of cleaning nozzle surfaces and/or nozzles of the recording head 6.

Figure 3:
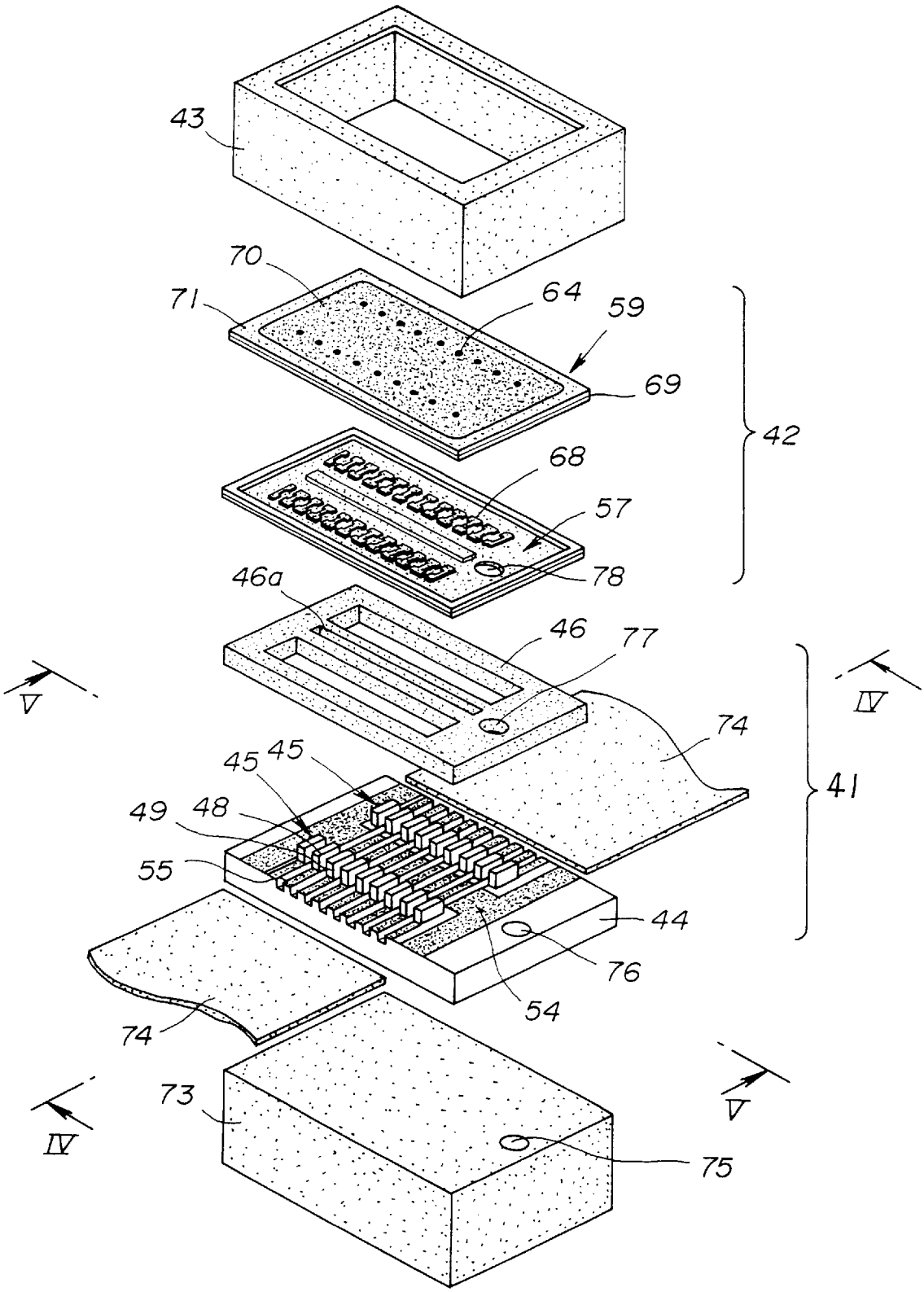
FIG. 3 is an exploded perspective view of an ink-jet head of the ink-jet recording apparatus shown in FIG. 1.
Figure 4:
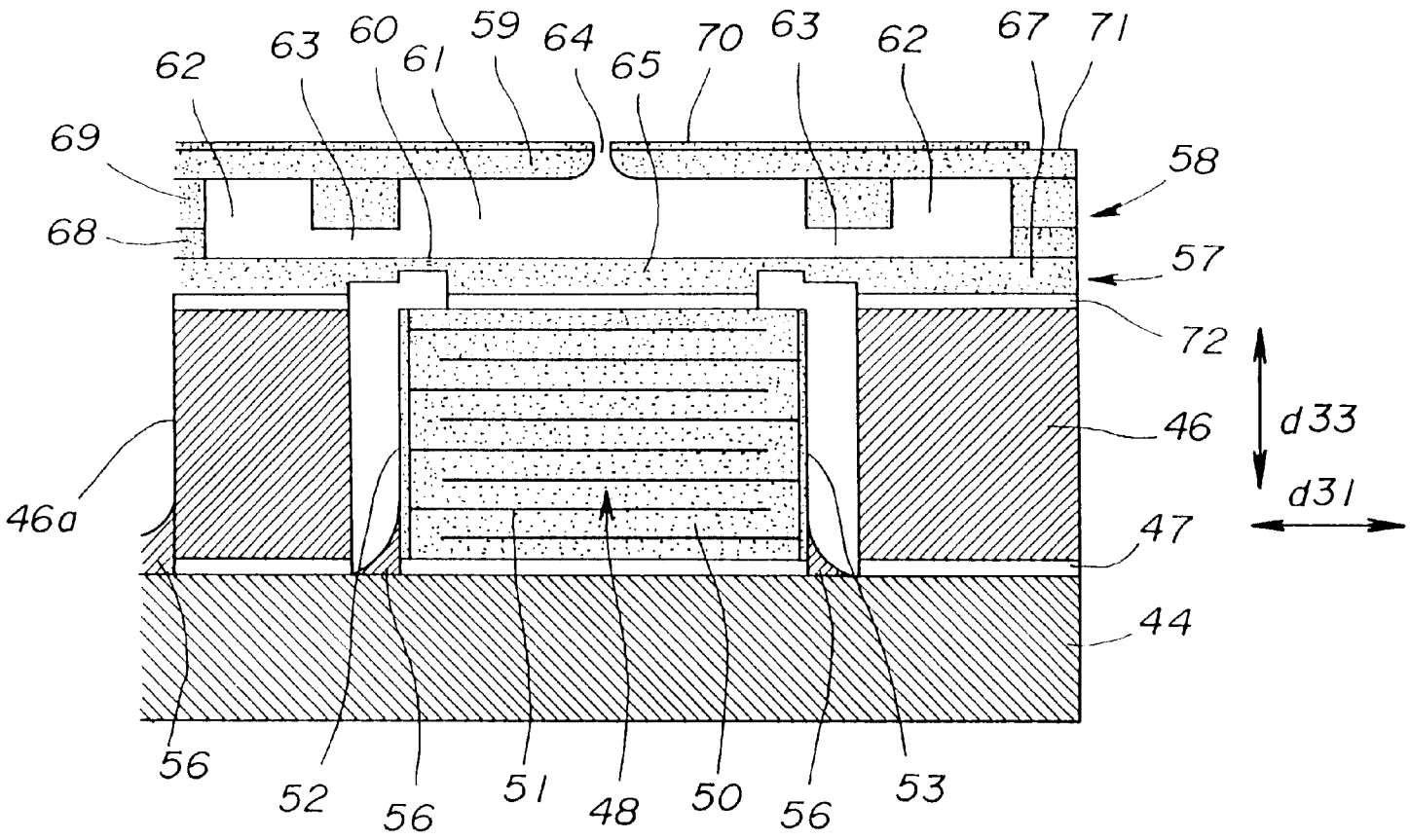
FIG. 4 is a partial magnified sectional view of the ink-jet head, shown in FIG. 3, taken by a line IV—IV.
Figure 5:
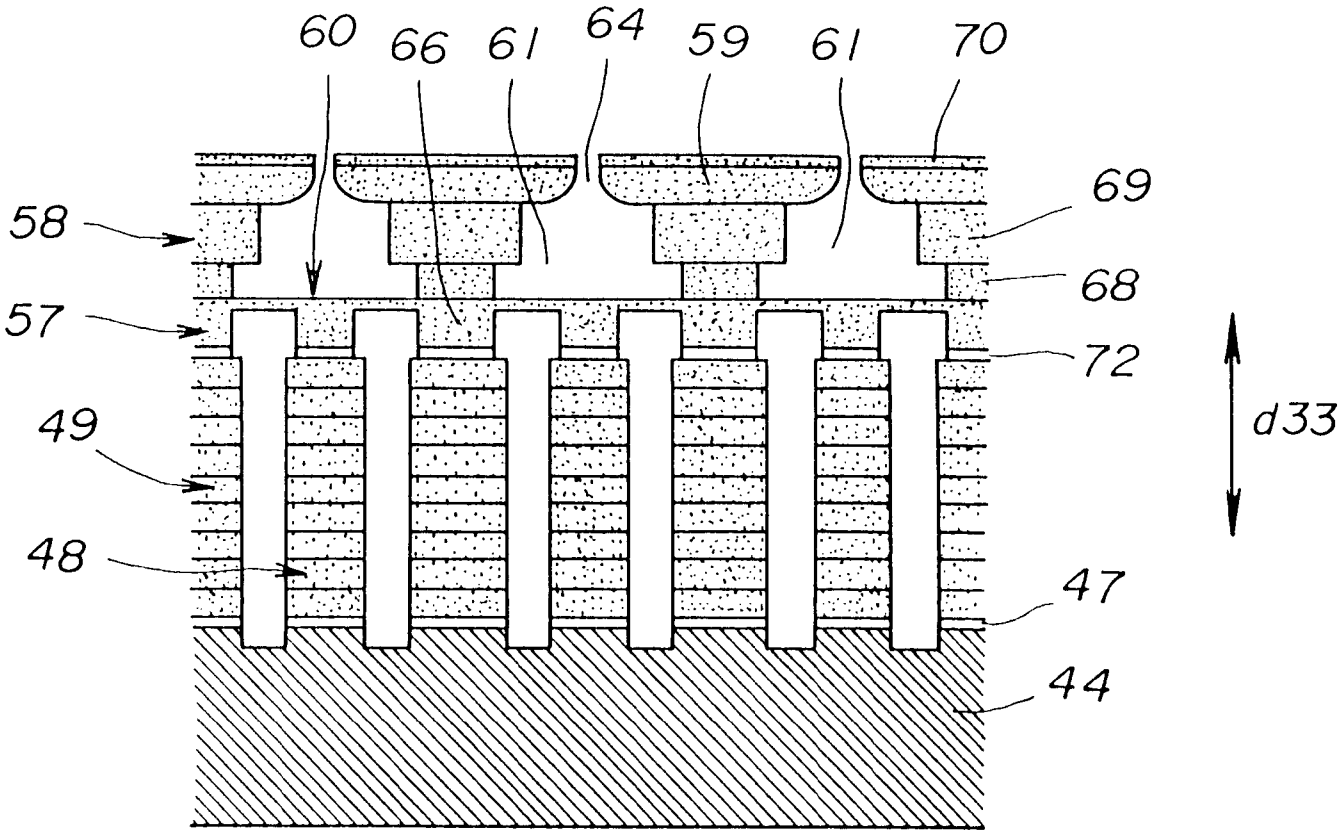
FIG. 5 is a partial magnified sectional view of the ink-jet head, shown in FIG. 3, taken by a line V—V.

An example of each of the ink-jet heads of the recording head 6 will be described with reference to FIGS. 3, 4 and 5. FIG. 3 shows an exploded perspective view of the ink-jet head, FIG. 4 shows a partial magnified sectional view of the ink-jet head taken by a line IV—IV, and FIG. 5 shows a partial magnified sectional view of the ink-jet head taken by a line V—V.

This ink-jet head includes a driving unit 41, an ink-chamber unit 42 and a head cover 43.

In the driving unit 41, on an insulation substrate 44 made of a ceramics substrate such as, for example, barium titanate, alumina, forsterite or the like, two rows of stacked piezoelectric elements 45 which are energy generating elements are disposed and bonded, and a frame member (supporting member) 46 made of resin, ceramics or the like which surrounds the two rows of stacked piezoelectric elements 45 is bonded by adhesive 47.

The piezoelectric elements 45 include piezoelectric elements 48, 48, . . . (referred to as 'driving portions'), to which a driving pulse for causing ink drops to fire is applied, and piezoelectric elements 49, 49, . . . (referred to as 'non-driving portions', each of which has no driving pulse applied thereto, is disposed between the driving portions 48, 48 and is used as an ink-chamber supporting member for fixing the ink-chamber unit 42 to the substrate 44. The driving portions 48, 48, . . . and the non-driving portions 49, 49, . . . are disposed alternately.

As each piezoelectric element 45, a stacked piezoelectric element having more than 10 layers is used. This stacked piezoelectric element includes, for example, as shown in FIG. 4, lead zirconate titanate (PZT) 50 having the thickness of 10–50 $\mu$m/layer and internal electrodes 51 made of silver palladium (AgPd) having the thickness of several $\mu$m/layer, which are stacked alternately. However, materials used as the piezoelectric element are not limited to the above-mentioned ones. It is possible to instead use another electromechanical transducing element.

The internal electrodes 51 of each piezoelectric element 45 are connected to left and right end-surface terminals 52, 53 alternately as shown in FIG. 4. The end-surface terminal 52 is disposed on a side on which the two rows of the piezoelectric elements face one another. The end-surface terminal 53 is disposed on the other side. On the substrate 44, as shown in FIG. 3, patterns of common terminals 54 and patterns of selection terminals 55 are formed by NiAu vapor deposition, Au plating, AgPt paste printing, AgPd paste printing or the like.

The end-surface terminals 52 of each row of piezoelectric elements 45 are connected to the common terminals 54, respectively, by conductive adhesive 56. The end-surface terminals 53 of each row of piezoelectric elements 45 are connected to the selection terminals 55, respectively, by the conductive adhesive 56. Thereby, as a result of applying a driving voltage (driving energy) to the driving portions 48, an electric field is generated in the stacked directions (directions d33). As a result, the driving portions 48 lengthen in the stacked directions. The patterns of the common terminals 54, connected with the respective piezoelectric elements, are electrically connected with each other as a result of a hole 48*a* formed in the frame member 46 being filled with the conductive adhesive 56, as shown in FIG. 4.

In the ink-chamber unit 42, a vibration plate 57 having a multi-layer structure formed of a layered product of metal thin layers, ink-chamber separation members 58, each having a two-layer structure formed of photosensitive resin layers formed of a dry film resist (DFR), and a nozzle plate 59 formed of metal, resin or the like, are stacked in the stated order and are connected with each other by heat fusion bonding. These members are used for forming one channel including one piezoelectric element 45 (driving portion 48), a diaphragm portion 60 provided for this driving portion 48, a pressure-application ink chamber 61 which has pressure applied thereto via the diaphragm portion 60, common ink chambers 62, 62 which are disposed on the two sides of the pressure-application ink chamber 61 and introduce ink to be supplied to the pressure-application ink chamber 61, ink supply paths 63, 63 which are flow resistance portions and cause the pressure-application ink chamber 61 to communicate with the common ink chambers 62, 62, and a nozzle 64 which communicates with the pressure-application ink chamber 61. A plurality of the channels are provided so as to form two rows.

The vibration plate 57 is formed of a two-layer structure of nickel plated films. The vibration plate 57 includes the diaphragm portion 60 for each driving portion 48, an insular projecting portion 65 which is integrally formed at the center of the diaphragm portion 60 and is bonded to the driving portion 48, a portion 66 which is bonded to the non-driving portion 49 and is used as a beam, and a peripheral thick portion 67 which is bonded to the frame member 46.

Each ink-chamber separation member 58 is formed from a first photosensitive resin layer 68 and a second photosensitive resin layer 69 which are connected by heat pressure bonding with one another. The first photosensitive resin layer 68 is formed as a result of previously dry film resist being coated on the vibration plate 57, exposure being performed using an appropriate mask, and developing being performed so that a predetermined ink-chamber pattern is formed. The second photosensitive resin layer 69 is formed as a result of previously dry film resist being coated on the nozzle plate 59, exposure being performed using an appropriate mask, and developing being performed so that a predetermined ink-chamber pattern is formed.

The many nozzles 64, each of which is a minute hole through which an ink drop is fired, are formed in the nozzle plate 59. The internal shape (inside shape) of each nozzle 64 is an approximately cylindrical shape, an approximately truncated cone shape, a horn shape, or the like. The diameter of each nozzle 64 is approximately 25–35 $\mu$m at the ink-drop exit side. The ink firing surface of the nozzle plate 59 is a water-repellency-treated surface 70 (see FIG. 3). For example, the water-repellency-treated surface 70 is formed of a water-repellency-treated film formed on the ink firing surface of the nozzle plate 59. The water-repellency-treated film is selected depending on the physical properties of the ink, from a film formed as a result of PTFE-Ni eutectoid plating, a film formed as a result of electrodeposition coating of fluoroplastics, a film formed as a result of vapor-deposition coating of fluoroplastics having a vapor-deposition property (for example, pitch fluoride), and a film formed as a result of baking after coating of solvent of silicon-based resin and fluorine-based resin. Thereby, an ink-drop shape and ink-drop flying characteristics are stabilized, and thus, a high-quality image can be obtained. A non-water-repellency-treated surface 71 on which water-repellency-treated film is not formed is provided at the periphery of the nozzle plate 59 (see FIG. 3).

These driving unit 41 and ink-chamber unit 42 are processed and assembled separately. Then, the vibration plate 57 of the ink-chamber unit 42, and the piezoelectric elements 45 and the frame member 46 of the driving unit 41 are bonded by adhesive 72 (see FIGS. 4 and 5).

Then, the substrate 44 is supported and held on a spacer member (head holder) 73 which acts as a head supporting member. FPC cables 74, 74 are used for connecting between a PCB (printed-circuit board) which has a head driving IC and so forth and is disposed in the spacer member 73, and the respective terminals 54, 55 connected with the respective driving portions 48 of the piezoelectric elements 45 of the driving unit 41.

The head cover (nozzle cover) 43 (see FIG. 3) has a shape of a box and covers the periphery of the nozzle plate 59 and the side surfaces of the head. An opening formed in the head cover 43 is formed so as to be aligned with the water-repellency-treated surface 70 of the nozzle plate 59, and the head cover 43 is bonded to the non-water-repellency-treated surface 71 of the nozzle plate 59 by adhesive. Further, ink supply holes 75–78 are formed in the spacer member 73, the substrate 44, the frame member 46 and the vibration plate 57, respectively, for supplying ink to the ink chambers from the ink cartridge 7 (see FIG. 2).

In this ink-jet head, as a result of applying a driving waveform (pulse voltage of 10 through 50 V), in accordance with a recording signal, to the driving portion 48, the driving portion 48 lengthens in the stacked directions (d33). As a result, the pressure-application ink chamber 61 has pressure applied thereto via the diaphragm portion 60 of the vibration plate 57 so that the pressure in the pressure-application ink chamber 61 increases. As a result, an ink drop is fired from the nozzle 64. At this time, ink also flows to the ink supply paths 63, 63. However, by narrowing the sectional areas of the ink supply paths 63, 63 so as to cause the ink supply paths 63, 63 to act as the flow resistance portions, flow of the ink to the common ink chamber 62, 62 is reduced, and thus, degradation of the ink-firing efficiency is avoided.

After finish of ink firing, the pressure of the ink in the pressure-application ink chamber 61 decreases, and, due to the inertia of the ink and the waveform of the diving pulse, a negative pressure occurs in the pressure-application ink chamber 61. Then, an ink filling process is performed in the inkjet head. Ink supplied from the ink cartridge 7 flows into the common ink chamber 62, 62, then flows into the pressure-application ink chamber 61 via the ink supply paths 63, 63, and the pressure-application ink chamber 61 is filled with the ink. Then, vibration of the meniscus surface of the ink near the exit of the nozzle 64 attenuates, is returned to the position near the exit of the nozzle 64 due to surface tension, and reaches a (refilled) stable condition. Then, a subsequent ink firing operation may be performed.

Figure 6:
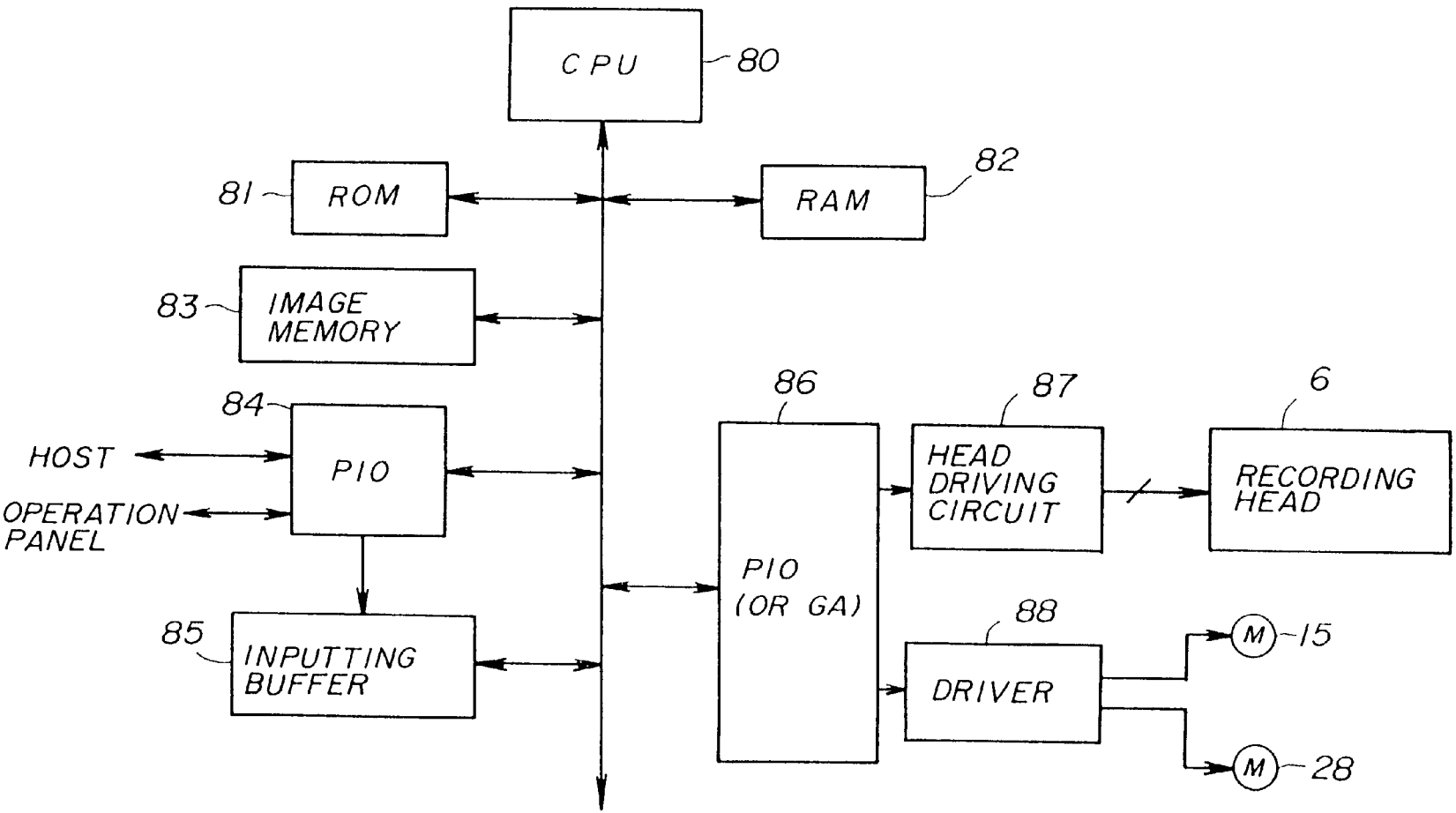
FIG. 6 shows a general block diagram of a control portion of the ink-jet recording apparatus in the first embodiment of the present invention.

A control portion of the above-described ink-jet recording apparatus will be generally described with reference to FIG. 6.

This control portion includes a microcomputer (hereinafter, referred to as 'CPU') 80 which controls the entirety of the recording apparatus, a ROM 81 which stores necessary fixed information, a RAM 82 which is used as a working memory, and so forth, an image memory 83 which stores data obtained as a result of image information being processed, a parallel inputting and outputting (PIO) port 84, an inputting buffer 85, gate array (GA) or parallel inputting and outputting (PIO) port 86, a head driving circuit 87 and a driver 88.

To the PIO port 84, image information from a host, data such as data for indicating a paper type, various specifying information from an operation panel (not shown in the figure), a detection signal from a paper presence detecting sensor which detects the beginning edge and the ending edge of the paper, signals from various sensors such as a home position sensor which detects whether or not the carriage 5 is positioned at a home position (reference position) are input. Further, various information is sent to the host and operation panel via the PIO port 84.

Based on various data and signals given via the PIO port 86, the head driving circuit 87 applies a driving waveform, selected from a plurality of driving waveforms, to each of the piezoelectric elements of firing nozzles (which are caused to fire ink drops) selected from the piezoelectric elements of the respective nozzles of the recording head 6 in accordance with the image information.

The driver 88, in accordance with driving data given via the PIO port 86, drives the main-scan motor 15 and the sub-scan motor 28 so as to cause the carriage 5 to move in the main-scan directions, and cause the platen 21 to rotate so as to convey the paper 20 by a predetermined length.

Figure 7:
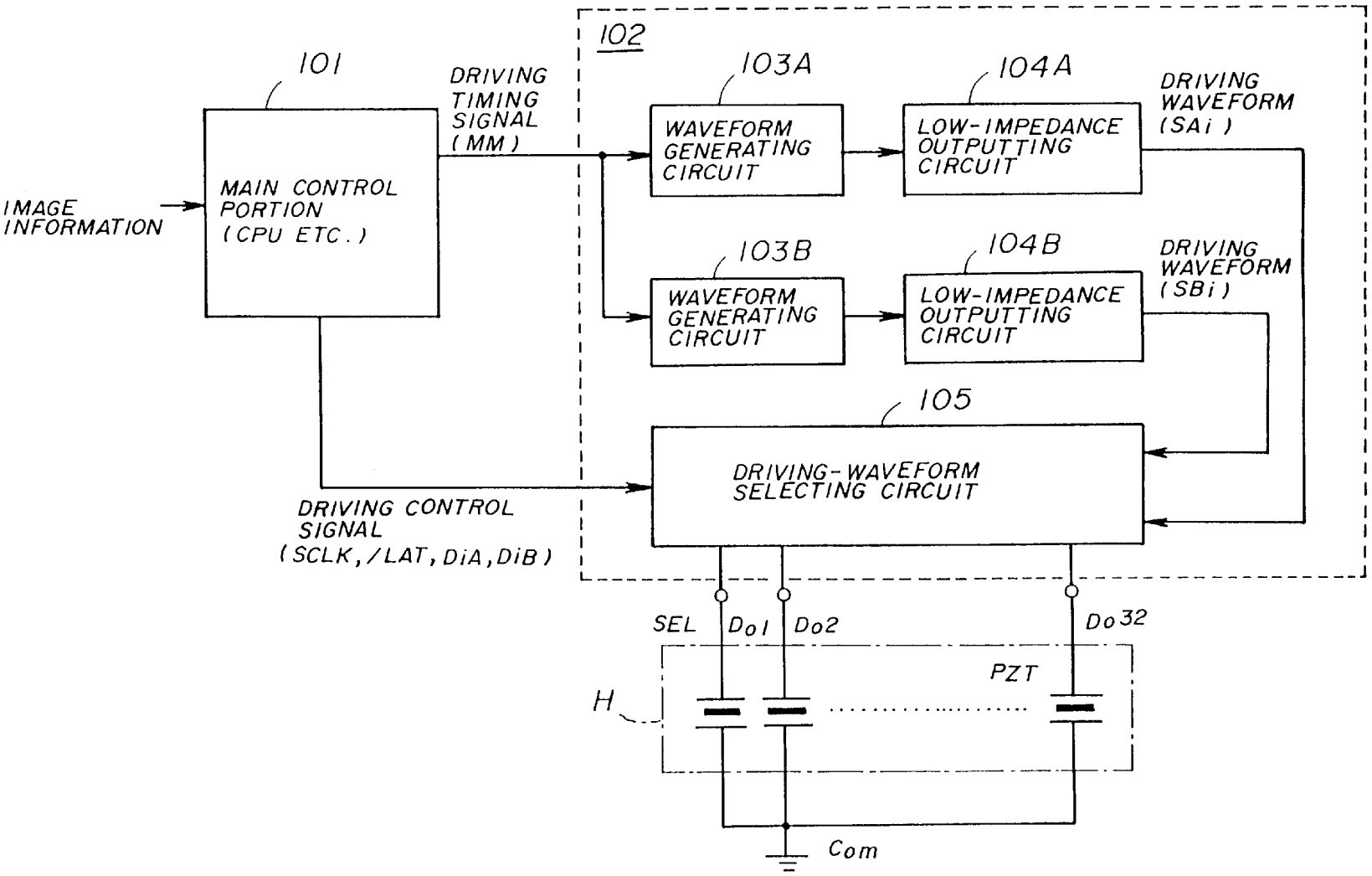
FIG. 7 shows a block diagram of a portion of the control portion, shown in FIG. 6, which concerns recording-head driving control.

A portion of the above-described control portion which concerns recording-head driving control will now be described in detail with reference to FIG. 7. This figure shows only the portion concerning the recording-head driving control for a single head.

The ink-jet head H of the recording head 6 has the piezoelectric elements (energy generating elements) PZT for the nozzles 64, respectively. It is assumed that the ink-jet head H has the 32 piezoelectric elements PZT for the 32 nozzles 64, respectively. The terminal 52 of each piezoelectric element PZT is connected to the common terminal Com (54) in common. The terminal 53 of each piezoelectric element PZT is connected to the selection terminal SEL (55) individually. Actually, the two rows of nozzles 64 are provided, and the ink-jet head H has the 64 nozzles 64 in total.

A head driving control portion for driving and controlling this head includes a main control portion 101 including the CPU 80, ROM 81, RAM 82 and the peripheral circuits, and a head driving portion 102 for driving the ink-jet head H. Because the head driving portion 102 is provided for the head of each color, the head driving circuit 87 includes the four head driving portions 102.

Image information is input to the main control portion 101 from the host such as a personal computer. Then, the main control portion 101 outputs, to the head driving portion 102, a driving timing signal MM which determines timing in which the driving waveforms are generated, and a driving control signal which includes serial data (nozzle data) DiA, DiB for specifying nozzles to fire ink drops for the respective driving waveforms, and timing signals (shift clock signal SCLK, a latch signal /LAT).

The head driving portion 102 includes waveform generating circuits 103A, 103B for inputting the driving timing signal MM thereto and generating two kinds of driving waveforms (a driving waveform SAi and a driving waveform SBi) for driving the piezoelectric elements PZT of the nozzles, low-impedance outputting circuits 104A, 104B for outputting the outputs (the driving waveforms SAi, SBi) of the respective waveform generating circuits 103A, 103B, and a driving-waveform selecting circuit 105 which, based on the driving control signal from the main control portion 101, selects one of the two driving waveforms SAi, SBi and outputs the selected waveform to each of the selection terminals Do1 through Do32 of the ink-jet head H.

Each of the waveform generating circuits 103A, 103B includes, for example, a ROM, a D-A converter or other pulse generating circuit and differentiating and integrating circuit, and a waveform modifying circuit such as a clipping circuit, a clamping circuit and/or the like. In addition to the driving timing signal MM, a Vp control signal SVp for selecting a maximum driving voltage Vp of the driving waveform (and/or a tr control signal Str for selecting the rising time constant tr of each driving waveform, to be described later) and so forth is input to the waveform generating circuits 103A, 103B.

Each of the low-impedance outputting circuits 104A, 104B includes a low-impedance amplifier including a buffer amplifier, SEPP (Single Ended Push Pull) circuit and so forth. By using the low-impedance outputting circuits 104A, 104B, the outputs of the driving waveforms are low-impedance outputs to the piezoelectric elements. As a result, distortion of the waveforms due to variations of the piezoelectric elements and/or difference in the number of nozzles to be used is avoided.

An example of the waveform generating circuit 103A and low-impedance outputting circuit 104A will now be described with reference to FIGS. 8 through 10. The waveform generating circuit 103B and low-impedance outputting circuit 104B have similar arrangements.

Figure 8:
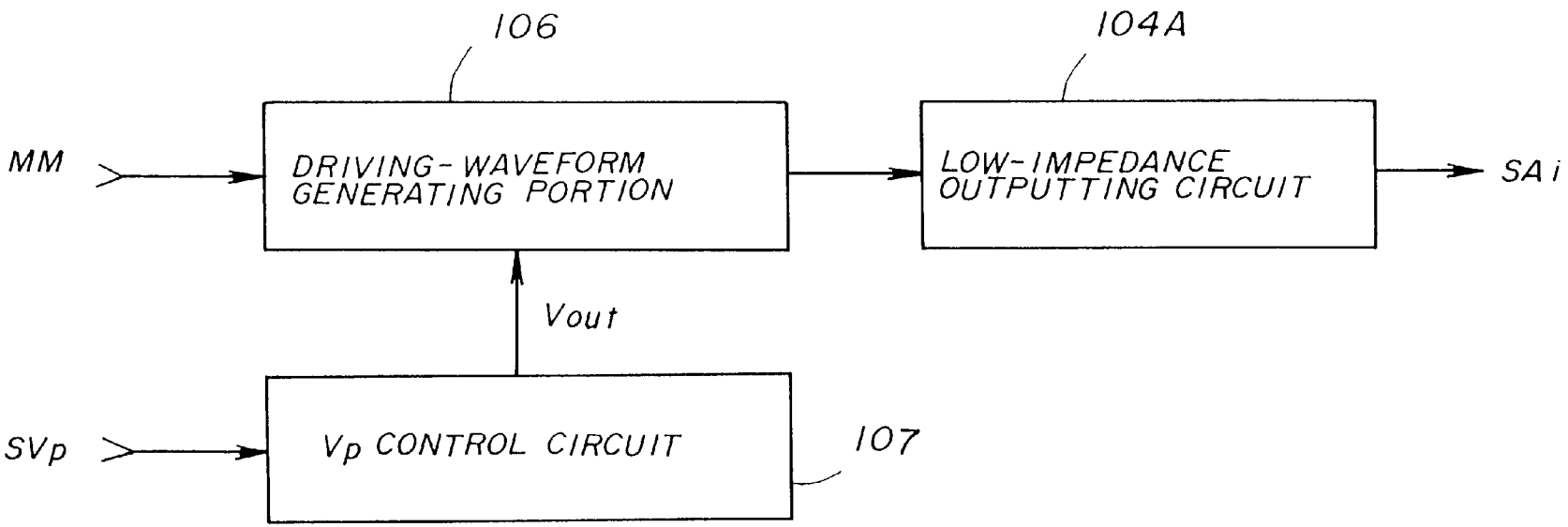
FIG. 8 shows a block diagram of one example of a waveform generating circuit shown in FIG. 7.

As shown in FIG. 8, the waveform generating circuit 103A includes a driving-waveform generating portion 106 and a Vp control circuit 107. The driving-waveform generating portion 106 inputs the driving timing signal MM thereto, generates a driving waveform, and supplies the thus-generated driving waveform to the low-impedance outputting circuit 104A. The Vp control circuit 107 generates a voltage Vout, which determines the maximum driving voltage Vp of the driving waveform of the driving-waveform generating portion 106, in accordance with the Vp control signal SVp, and outputs the thus-generated voltage Vout.

The driving-waveform generating portion 106 and the low-impedance outputting circuit 104A form a constant-voltage driving circuit. As shown in FIG. 9, in the driving-waveform generating portion 106 and the low-impedance outputting circuit 104A, an inputting terminal IN, to which the driving timing signal MM is input, is connected to the base of a transistor Tr1 via a buffer B, and also is connected to the base of a transistor Tr2 via an inverter I. A power source voltage Vpp is applied to the emitter of the transistor Tr1, and the emitter of the transistor Tr2 is grounded.

A series circuit of a charging resistor Ra and a diode DI is connected to the collector of the transistor Tr1. A series circuit of a discharging resistor Rb and a diode D2 is connected to the collector of the transistor Tr1. The cathode of the diode D1 is connected with the anode of the diode D2. A capacitor Ck is connected between the connection point 'a' of the above-mentioned connection and the ground. The charging resistor Ra and the capacitor Ck form a time-constant circuit used at a time of charging. The discharging resistor Rb and the capacitor Ck form a time-constant circuit used at a time of discharging. The voltage Vout from the Vp control circuit 107 is applied to the above-mentioned connection point 'a' via a diode Dk.

The connection point 'a' is connected to a connection point between the base of a transistor Tr3 and the base of a transistor Tr4. These transistors Tr3 and Tr4 are inputting-side ones of the low-impedance outputting circuit 104A including transistors Tr3 through Tr6. The transistors Tr5 and Tr6 are outputting-side ones of the low-impedance outputting circuit 104A. The driving waveform SAi is obtained from a connection point between the emitter of the transistor Tr5 and the collector of the transistor Tr6, and is output to the driving-waveform selecting circuit 105.

Figure 9:
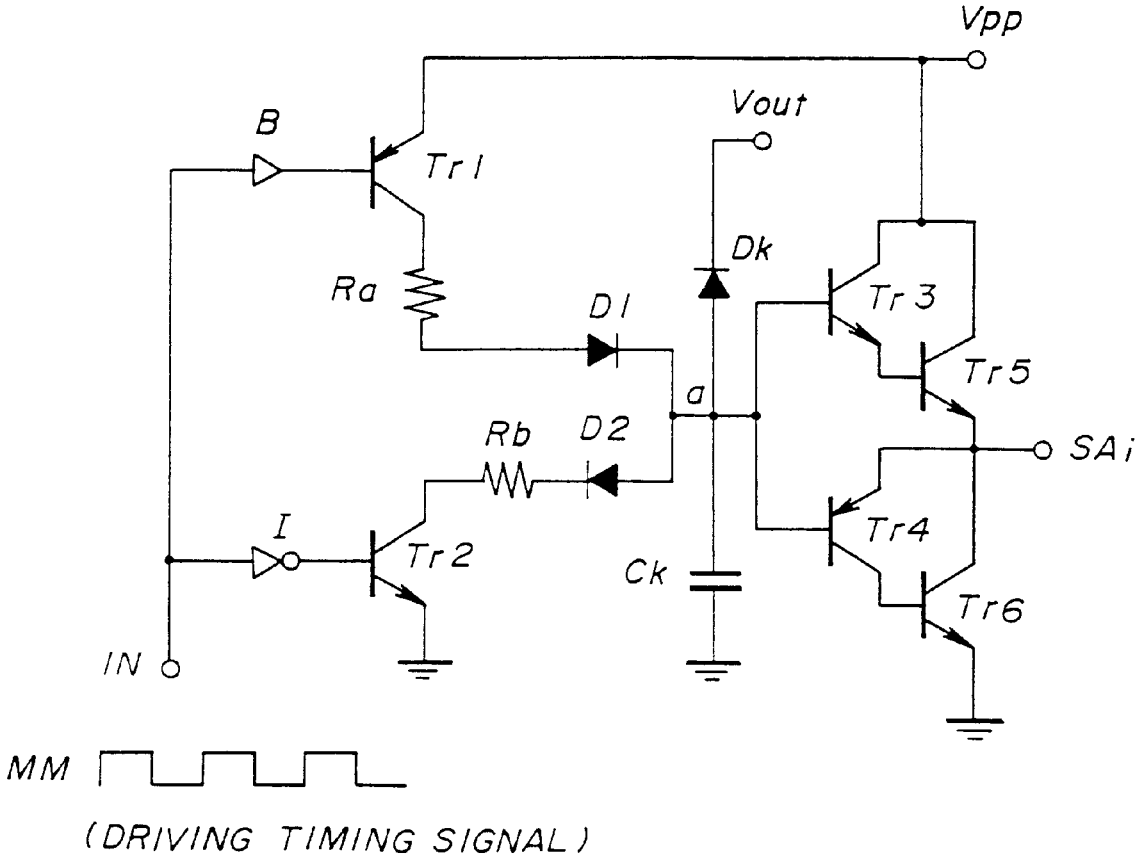
FIG. 9 shows a circuit diagram of one example of a driving waveform generating portion and a low-impedance outputting circuit, shown in FIG. 8.

In this circuit shown in FIG. 9, when the driving timing signal MM is input to the inputting terminal IN and an 'H' level is input to the buffer B, the buffer B outputs a voltage which is lower than the power source voltage Vpp, and the transistor Trn turns on. At the same time, the inverter I outputs an 'L' level, and the transistor Tr2 turns off. As a result, charging of the capacitor Ck by the power source voltage Vpp, at a charging time constant which is determined by the charging resistor Ra and the capacitor Ck, is started.

At this time, because the voltage Vout is applied to the connection point 'a' via the diode Dk (causing a voltage drop Vd), the charged voltage of the capacitor Ck does not rise to the power source voltage Vpp. By the diode Dk, the charged voltage of the capacitor Ck is clipped at the voltage (Vout−Vd). This voltage is the maximum voltage VpA of the driving voltage of the driving waveform SAi (VpA=Vout−Vd).

When the level 'L' is input to the buffer B, the output voltage of the buffer B is equal to the power source voltage Vpp. As a result, the transistor Tr1 turns off. At this time, the output voltage of the inverter I has the level 'H', and the transistor Tr2 turns on. As a result, discharging of the capacitor Ck, which has been charged to the voltage VpA, at a discharging time constant which is determined by the discharging resistor Rb and the capacitor Ck, is started.

Thus, by changing the voltage Vout applied to the driving-waveform generating portion 106, it is possible to control the maximum voltage VpA of the driving waveform SAi.

Similarly, it is possible to control the maximum voltage VpB of the driving waveform SBi output from the waveform generating circuit 103B and the low-impedance outputting circuit 104B.

Figure 10:
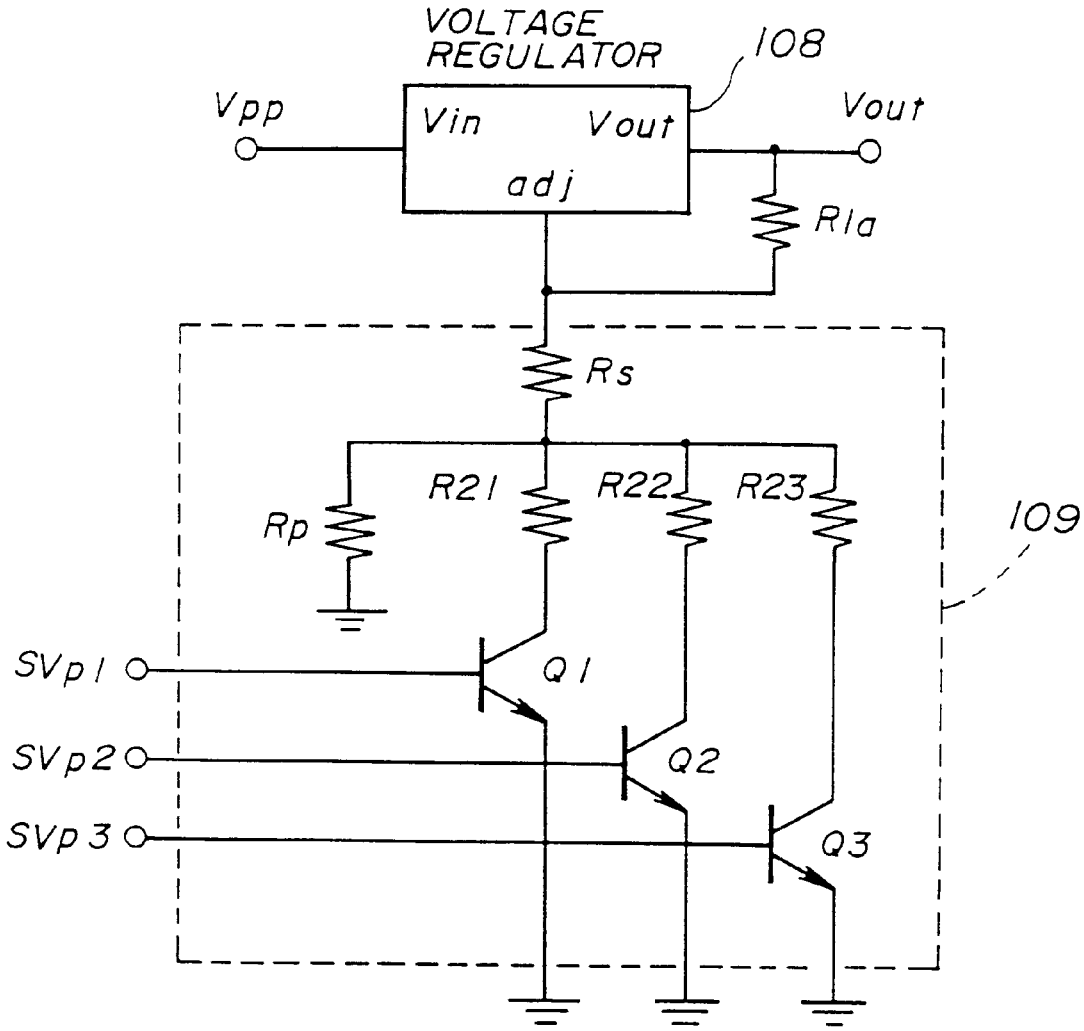
FIG. 10 shows a circuit diagram of one example of a Vp control circuit, shown in FIG. 8.

As shown in FIG. 10, the Vp control circuit 107, which generates and outputs the voltage Vout which determines the maximum voltage VpA of the driving waveform SAi, includes a three-terminal regulator 108 and a resistor selecting circuit 109. As a result of the constant voltage Vpp being applied to a voltage inputting terminal Vin, the three-terminal regulator 108 outputs a voltage from a voltage outputting terminal Vout in accordance with a resistor R1*a* connected between an adjustment terminal 'adj' and the outputting terminal Vout and a resistance R2 of the resistor selecting circuit 109 connected between the adjustment terminal 'adj' and the ground. For example, LM317T (trade name) manufactured by National Semiconductor Corp. can be used as the three-terminal regulator 108. The output voltage Vout of the three-terminal regulator 108 is determined, for example, by the following equation:

$$Vout=1.25\times(1+R2/R1a)\times Vpp$$

In the resistor selecting circuit 109, a resistor Rs is connected, in series, with a parallel circuit of a resistor Rp and one of resistors R21, R22 and R23. The one of the resistors R21, R22 and R23 is selected by switching transistors Q1, Q2 and Q3. For example, SN7406 (trade name) manufactured by Texas Instruments Inc. can be used as the resistor selecting circuit 109. The Vp control signal from the main control portion 101 is input to the resistor selecting circuit 109. Specifically, 3 bits of Vp control signal, SVp1, SVp2 and SVp3 are input to the bases of the transistors Q1, Q2 and Q3, respectively.

As a result of applying the power source voltage Vpp to the three-terminal regulator 108, and also, applying the 3 bits of the Vp control signal, SVp1, SVp2 and SVp3 from the main control portion 101 to the three-terminal regulator 108, it is possible to change the output voltage Vout to a maximum of seven levels. As a result of applying the output voltage Vout to the driving-waveform generating portion 106, it is possible to set the maximum voltage VpA of the driving waveform SAi to a predetermined value.

Such generation of the different voltages Vout can be instead achieved by using, for example, a voltage dividing circuit in which a resistor is connected, in series, with a parallel circuit of a variable resistor and a capacitor. The voltage across the capacitor is used as the output voltage Vout. By changing the resistance of the variable resistor, it is possible to change the output voltage Vout. Further, it is also possible to instead use a D-A converter so as to change the output voltage Vout.

The driving-waveform selecting circuit 105 will now be described with reference to FIG. 11. The driving-waveform selecting circuit 105 includes two 32-bit shift register circuits 111A, 111B, to which the shift clock signal SCLK and serial data DiA, DiB are input, a 64-bit latch circuit 112 which latches the respective outputs of the shift register circuits 111A, 111B at the timing of the latch signal /LAT (where, '/' means inverting), a 64-bit level shifter circuit 113, and a group of analog switches 114 which are controlled by the outputs of the level shifter circuit 113.

The group of analog switches 114 includes pairs of analog switches, ASA1 and ASB1, ASA2 and ASB2, . . . , ASA32 and ASB32, which are connected to the selection terminals of the PZTs, Do1, Do2, . . . , Do32, respectively. The driving waveform SAi is input to the analog switches ASA1, ASA2, . . . , ASA32 while the driving waveform SBi is input to the analog switches ASB1, ASB2, . . . , ASB32.

The serial data DiA, DiB is taken by the shift resister circuits 111A, 111B at the timing of the shift clock signal SCLK, respectively, and the serial data DiA, DiB taken by the shift register circuits 111A, 111B is latched by the latch circuit 112 at the timing of the latch signal /LAT. The serial data DiA, DiB, thus latched by the latch circuit 112, is then input to the level shifter circuit 113 from the latch circuit 112.

The level shifter circuit 113, in accordance with the contents of the serial data DiA, DiB, turns on one of the pair of two analog switches ASAm and ASBm (m=1 through 32), connected to the respective one of the piezoelectric elements PZTs, and turns off the other of the pair of two analog switches, or turns off every one of the pair of two analog switches. Thereby, either one of the driving waveforms SAi, SBi is selected and is applied to the piezoelectric element PZT, or none of the driving waveforms is applied to the piezoelectric element PZT.

Operations of the above-described ink-jet recording apparatus will now be described with reference to FIGS. 12A–12J and 13.

Figure 12:
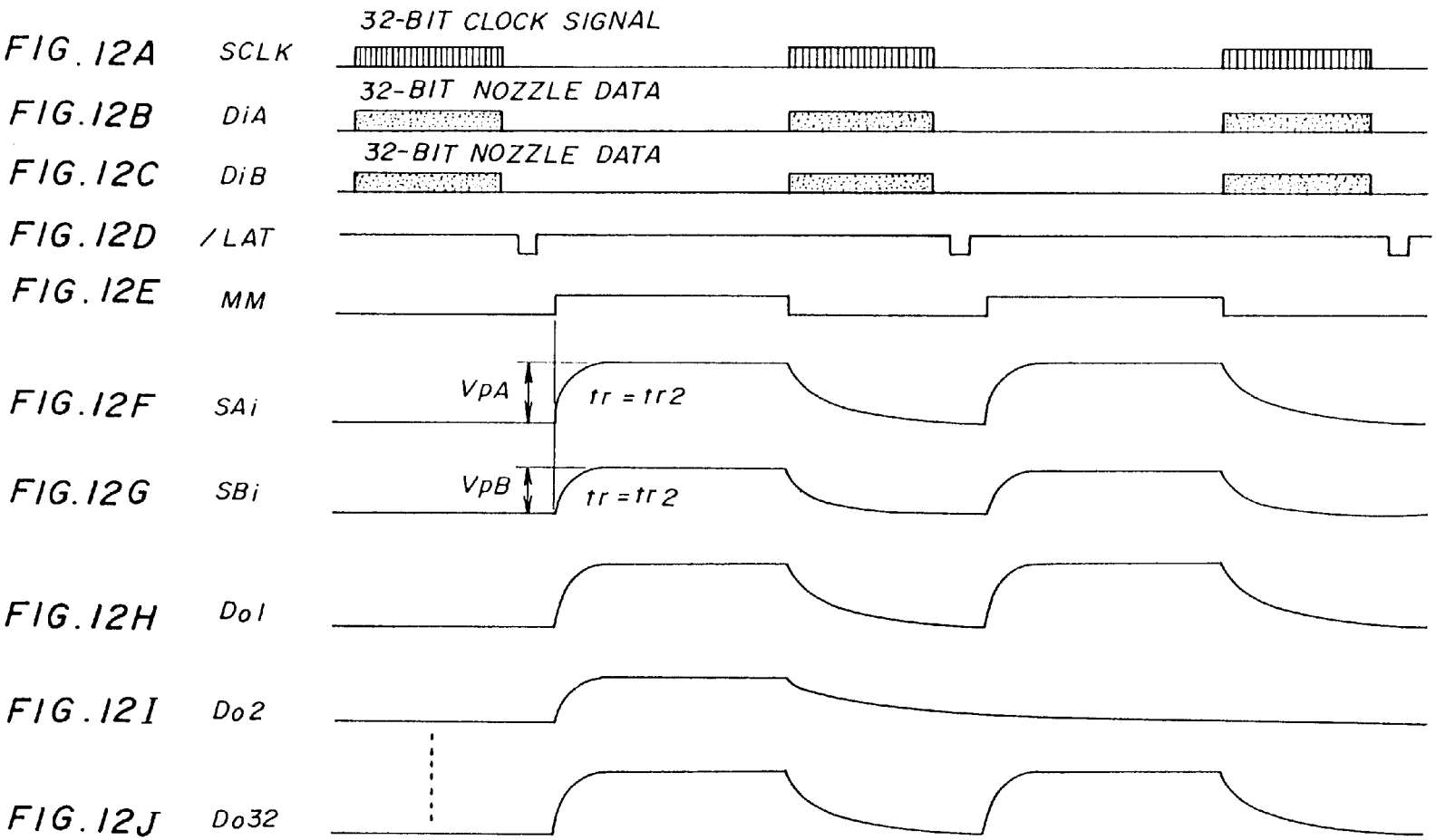
FIGS. 12A, 12B, 12C, 12D, 12E, 12F, 12G, 12H, 12I and 12J illustrate functions of he/portion, of the control portion, which concerns recording-head driving control, shown in FIG. 7.

With reference to FIGS. 12A–12J, the serial data (nozzle data) DiA, DiB and timing signals (shift clock signal SCLK and latch signal /LAT) are output, as the driving control signal, from the main control portion 101 to the driving-waveform selecting circuit 105 of the head driving portion 102. Thereby, at the timing of the shift clock signal SCLK shown in FIG. 12A, 32 bits of the nozzle data (serial data) DiA, shown in FIG. 12B, are taken by the shift register circuit 111A, and 32 bits of the nozzle data (serial data) DiB, shown in FIG. 12C, are taken by the shift register circuit 111B. The nozzle data DiA, DiB taken by the shift register circuits 111A, 111B, respectively, is then input to the level shifter circuit 113 at the timing of the latch signal /LAT shown in FIG. 12D.

The main control portion 101 outputs the driving timing signal MM, shown in FIG. 12E, to the waveform generating circuits 103A, 103B at the predetermined timing. Thereby, the driving waveform SAi, shown in FIG. 12F, of the rising time constant tr (=tr2) and the maximum voltage VpA, is output from the waveform generating circuit 103A, while the driving waveform SBi, shown in FIG. 12G, of the rising time constant tr (=tr2) and the maximum voltage VpB, is output from the waveform generating circuit 103B.

Then, through the analog switch, which is in the turned-on state, of the pair of analog switches ASAm and ASBm, the driving waveform SAi or SBi is output to the selection terminal Dom and is applied to the respective one of the piezoelectric elements PZTs. As a result, any one of the maximum driving voltages 0, VpB and VpA (0<VpB<VpA) is applied to each of the piezoelectric elements PZTs. For example, the maximum driving voltage VpA is applied to the aselection terminal Do1 first, and then, the maximum driving voltage VpA is applied to the selection terminal Do1 again, as shown in FIG. 12H. Similarly, the maximum driving voltage VpA is applied to the selection terminal Do32 first, and then, the maximum driving voltage VpA is applied to the selection terminal Do32 again, as shown in FIG. 12J. On the other hand, the maximum driving voltage VpB is applied to the selection terminal Do2 first, and then, the maximum driving voltage 0 is applied to the selection terminal Do2, as shown in FIG. 12I.

Figure 13:
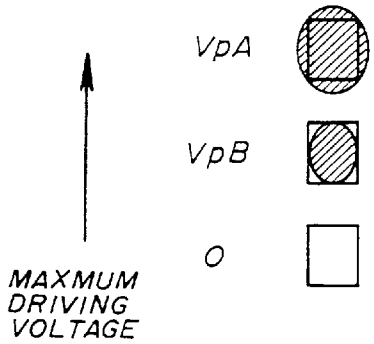
FIG. 13 shows a relationship between a maximum driving voltage of a driving waveform and a diameter of a dot formed on a recording medium as a result of an ink drop being fired from a nozzle as a result of the driving waveform having the maximum driving voltage being applied to a piezoelectric element.

The ink firing amount (ink-drop firing amount) Mj increases as the maximum driving voltage is increased. Therefore, by controlling the maximum driving voltage, it is possible to change a size of a dot, as shown in FIG. 13, which is formed as a result of an ink drop hitting paper.

Thus, as a result of generating a plurality of (two, in the above-described first embodiment) driving waveforms, selecting one of the plurality of driving waveforms in accordance with image information, and applying the selected driving waveform to a respective one of the energy generating elements (piezoelectric elements PZTs, in the above-described embodiment), it is possible to control a size of a dot and to record a multi-tone image, with a simple circuit arrangement.

Further, in this case, the image information is converted into the nozzle data (nozzle selection data) which is the serial data for each driving waveform, and the driving waveforms are selected in accordance with the nozzle data. As a result, when the driving-waveform selecting circuit is formed to be an IC which is to be loaded in the ink jet head, it is not necessary to specially provide an image information processing portion, and merely a simple circuit arrangement of the driving-waveform selecting circuit should be provided. In the circuit arrangement, the number of signal lines of the nozzle data (serial data) does not increase when the number of nozzles increases.

Figure 19:
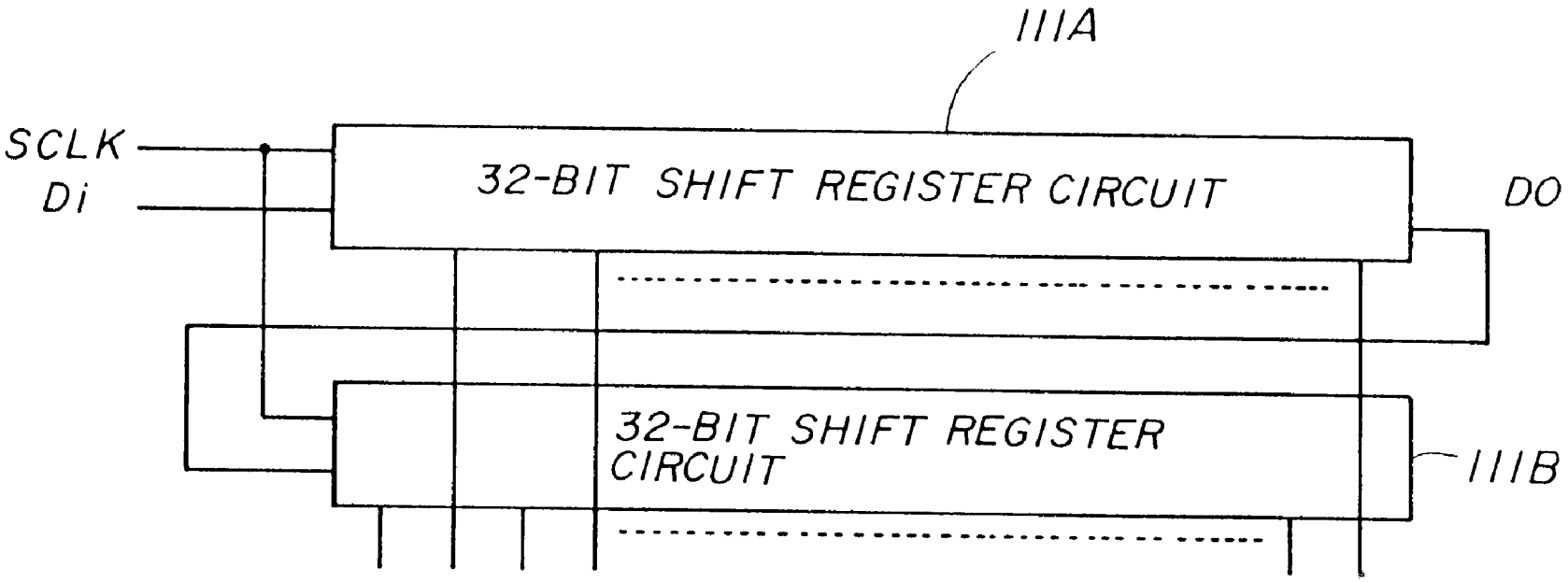
FIG. 19 illustrates a cascade connection of 32-bit shift register circuits.

As a result of cascade connection of the two 32-bit shift register circuits 111A, 111B, as shown in FIG. 19, the two data lines(for DiA, DiB, respectively), corresponding to the driving waveforms, SAi, SBi, respectively, are changed to one data line (for the 64-bit data). Thereby, it is possible to reduce the number of signal lines for the serial data corresponding to the plurality of driving waveforms, respectively, and thus, to reduce the cost for the signal transmission portion.

A second embodiment of the present invention will now be described. The second embodiment is the same as the first embodiment except for the following points. In the second embodiment, in the head driving portion 102 of the head driving control portion, the driving-waveform generating portion 106 and the low-impedance outputting circuit 104A in the first embodiment shown in FIG. 9 for the driving waveform SAi are replaced by the driving-waveform generating portion and the low-impedance outputting circuit shown in FIG. 14. Similarly, the driving-waveform generating portion 106 and the low-impedance outputting circuit 104B in the first embodiment for the driving waveform SBi are replaced by the driving-waveform generating portion and the low-impedance outputting circuit shown in FIG. 14.

Figure 14:
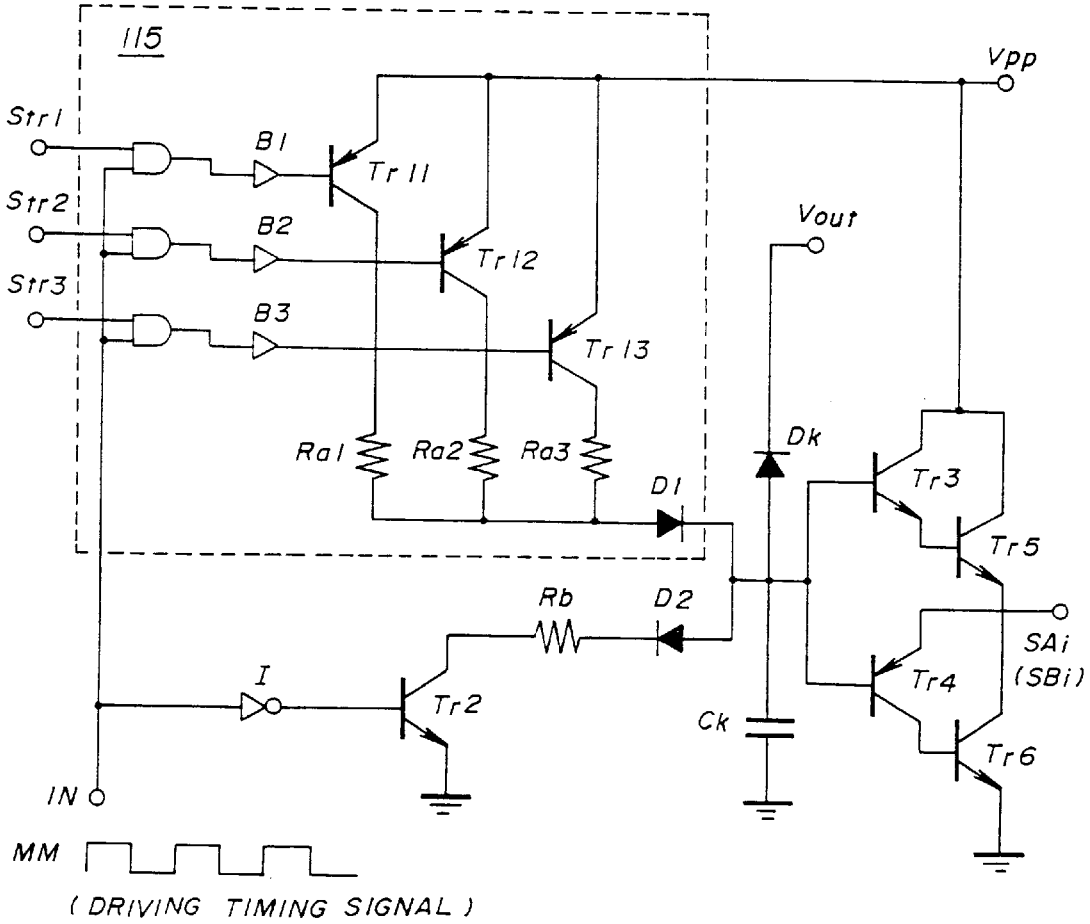
FIG. 14 shows a circuit diagram of one example of a driving waveform generating portion and a low-impedance outputting circuit, in a second embodiment of the present invention.

The driving-waveform generating portion and the low-impedance outputting circuit in the second embodiment shown in FIG. 14 include a tr control circuit 115 which changes the rising time constant tr as a result of the charging resistor Ra which is connected with the diode D1 in series being changed.

In the tr control circuit 115, as shown in FIG. 14, a parallel circuit of charging resistors Ra1, Ra2 and Ra3 is connected with the diode D1 in series. Switching transistors Tr11, Tr12 and Tr13 are connected between the charging resistors Ra1, Ra2 and Ra3, and the power source voltage Vpp, respectively. Buffers B1, B2 and B3 are connected with the bases of the transistors Tr11, Tr12 and Tr13, respectively, and, the driving timing signal MM is input to the buffers B1, B2 and B3 via gate circuits G1, G2 and G3, respectively. The gate circuits G1, G2 and G3 enter open states when tr control signals Str1, Str2 and Str3 from the main control portion 101 are in an 'H' level so as to output the driving timing signal MM to the buffers B1, B2 and B3, respectively.

Accordingly, when the main control portion 101 causes the driving timing signal MM to be in the 'H' level and also causes any one of the tr control signals Str1, Str2 and Str3 to be in the H level, the one of the buffers B1, B2 and B3 selected by the one of the tr control signals Str1, Str2 and Str3 outputs the voltage level lower than the power source voltage Vpp. As a result, the corresponding one of the transistors Tr11, Tr12 or Tr13 is turned on, and, the capacitor Ck is charged at the time constant determined by the capacitor Ck and the thus-selected one of the charging resistors Ra1, Ra2 and Ra3.

Thus, by the tr control signals, the capacitor Ck can be charged in one of a maximum of seven rising time constants tr. It is possible to select, generate and output one of three driving waveforms having the rising time constants tr1, tr2 and tr3, respectively.

It is possible to fix the voltage Vout which determines the maximum driving voltage Vp. However, in this case, using the Vp control circuit 107 shown in FIG. 10, the driving waveforms which have different rising time constants and different maximum driving voltages are generated and output.

Figures 15A, 15B, 15C, 15D:
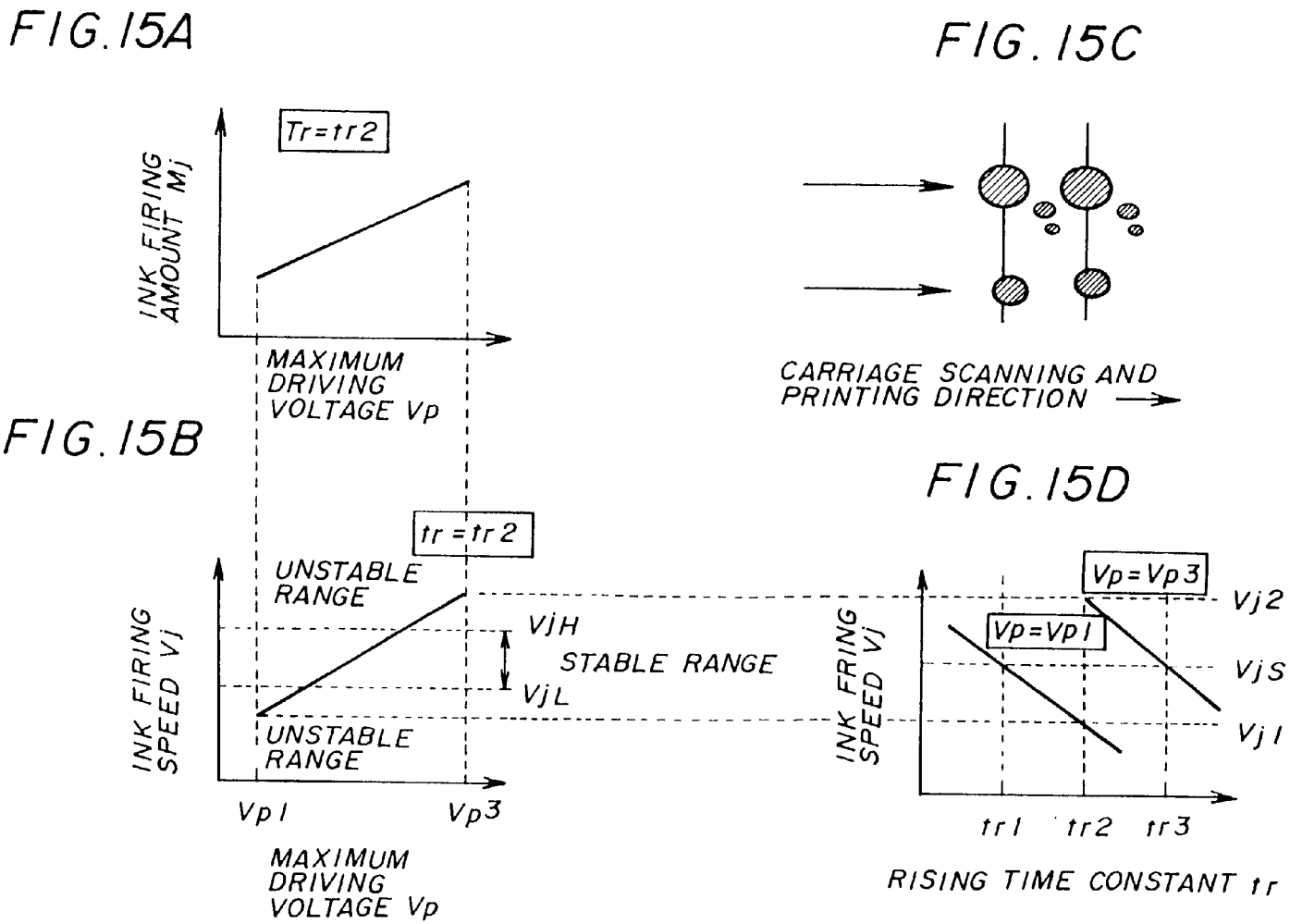
FIGS. 15A, 15B, 15C and 15D illustrate relationships between a maximum driving voltage Vp, an ink firing amount Mj, an ink firing speed Vj, a rising time constant tr, and a dot forming condition.

Functions of this second embodiment will now be described. As shown in FIG. 15A, the ink firing amount Mj increases as the maximum driving voltage Vp is increased (where it is assumed that the rising time constant tr is fixed to tr2). Accordingly, when a dot having a large diameter is to be formed on a recording medium, the maximum driving voltage Vp is set to be high, while, when a dot having a small diameter is to be formed on the recording medium, the maximum driving voltage Vp is set to be low.

On the other hand, as shown in FIG. 15B, the ink firing speed Vj increases when the maximum driving voltage Vp is increased, and an unstable firing condition occurs, in the range of Vj>VjH, wherein satellites are formed and/or bubbles are likely to be drawn into the nozzle. Further, the ink firing speed Vj decreases when the maximum driving voltage Vp is decreased, and an unstable firing condition occurs, in the range of Vj<VjL, wherein a direction in which ink is fired is unstable and a position at which fired ink is hit on the recording medium is shifted in comparison to the case where the ink firing speed Vj is high.

Thereby, when ink is fired in such unstable conditions, as shown in FIG. 15C, that is, when the maximum driving voltage Vp is too high, the diameter of the resulting dot is large while satellites are formed on the recording medium so that the image quality is degraded, and, when the maximum driving voltage Vp is too low, the diameter of the resulting dot is small while the position of the dot is shifted so that accuracy in positions of dots is degraded.

Therefore, in the second embodiment, the rising time constant tr is changed as the maximum driving voltage Vp is changed, so that the ink firing speed Vj is in the stable range although the maximum driving voltage Vp is changed. The ink firing speed Vj is in the unstable conditions either when the maximum driving voltage Vp=Vpl or when Vp=Vp3 as shown in FIG. 15B, in the case where the rising time constant tr of the driving waveform is fixed. However, the ink firing speed Vj decreases when the rising time constant tr is long while the ink firing speed Vj increases when the rising time constant tr is short, as shown in FIG. 15D. Accordingly, it is possible to set the ink firing speed Vj to be within the stable range as a result of selecting an appropriate rising time constant tr for each maximum driving voltage Vp.

Figure 16:
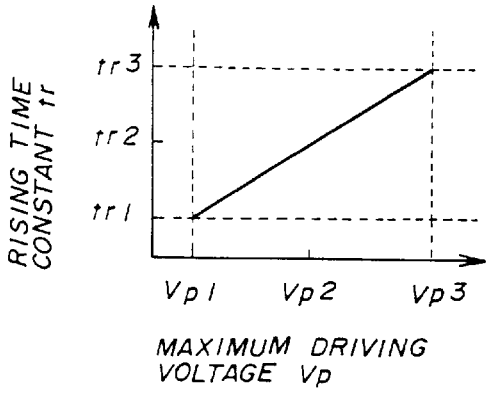
FIG. 16 illustrates the maximum driving voltage Vp and rising time constant tr of the driving waveform.
Figure 17:
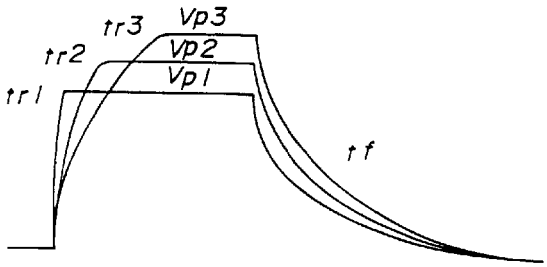
FIG. 17 shows an example of driving waveforms having different maximum driving voltages Vp and different rising time constants tr.

For example, as shown in FIG. 16, the rising time constant tr is set to tr1 when the maximum driving voltage Vp is Vp1, the rising time constant tr is set to tr2 when the maximum driving voltage Vp is Vp2, and the rising time constant tr is set to tr3 when the maximum driving voltage Vp is Vp3, where Vp1<Vp2<Vp3, and tr1<tr2<tr3. FIG. 17 shows the driving waveforms having the rising time constants tr1, tr2 and tr3, and the maximum driving voltages Vp1, Vp2 and Vp3, respectively.

Thus, as a result of generating and outputting the driving waveforms having the different maximum driving voltages Vp and the different rising time constants tr as the driving waveforms SAi and SBi output from the head driving portion 102, and selecting these driving waveforms through the driving-waveform selecting circuit 105 similarly to the case of the first embodiment, ink is fired in the stable range of the ink firing speed Vj, and dots having different diameters are formed, and thus, a multi-tone image is formed. Further, when variations in the ink firing amount Mj and the ink firing speed Vj are to be corrected, as a result of combinations of the maximum driving voltages Vp and the rising time constants tr being appropriately selected, a high-quality image can be obtained.

Figure 18:
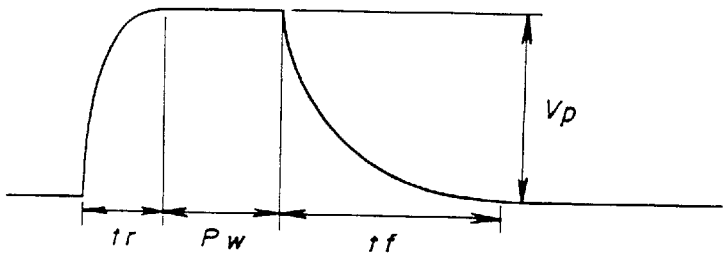
FIG. 18 illustrates the maximum driving voltage Vp, the rising time constant tr, a pulse width Pw and a decaying time constant tf of the driving waveform

Further, in accordance with the head structure and/or energy generating elements (electromechanical transducing elements or electrothermal transducing elements) to be used, the maximum driving voltage Vp, the rising time constant tr, a decaying time constant tf and a pulse width Pw, shown in FIG. 18, are controlled so that the ink firing amount Mj and the ink firing speed Vj are controlled, and thus, dots having different diameters can be formed.

For example, when the piezoelectric element is used as the energy generating element, and an ink drop is fired at the time of decaying in the driving waveform, such as in a case where a transformation in the d31 directions (shown in FIG. 4) of the piezoelectric element is used, the decaying time constant tf is controlled instead of the rising time constant.

The arrangement of the head driving portion and the driving waveforms are not limited to those described above. Any other arrangement of the head driving portion and driving waveforms can be used as long as an ink drop is stably fired. As the driving waveform, a triangle waveform, a sine waveform, or the like can be used. Further, as the plurality of different driving waveforms, it is also possible to use three or more different waveforms, instead of two different waveforms SAi, SBi as described above.

Figure 20:
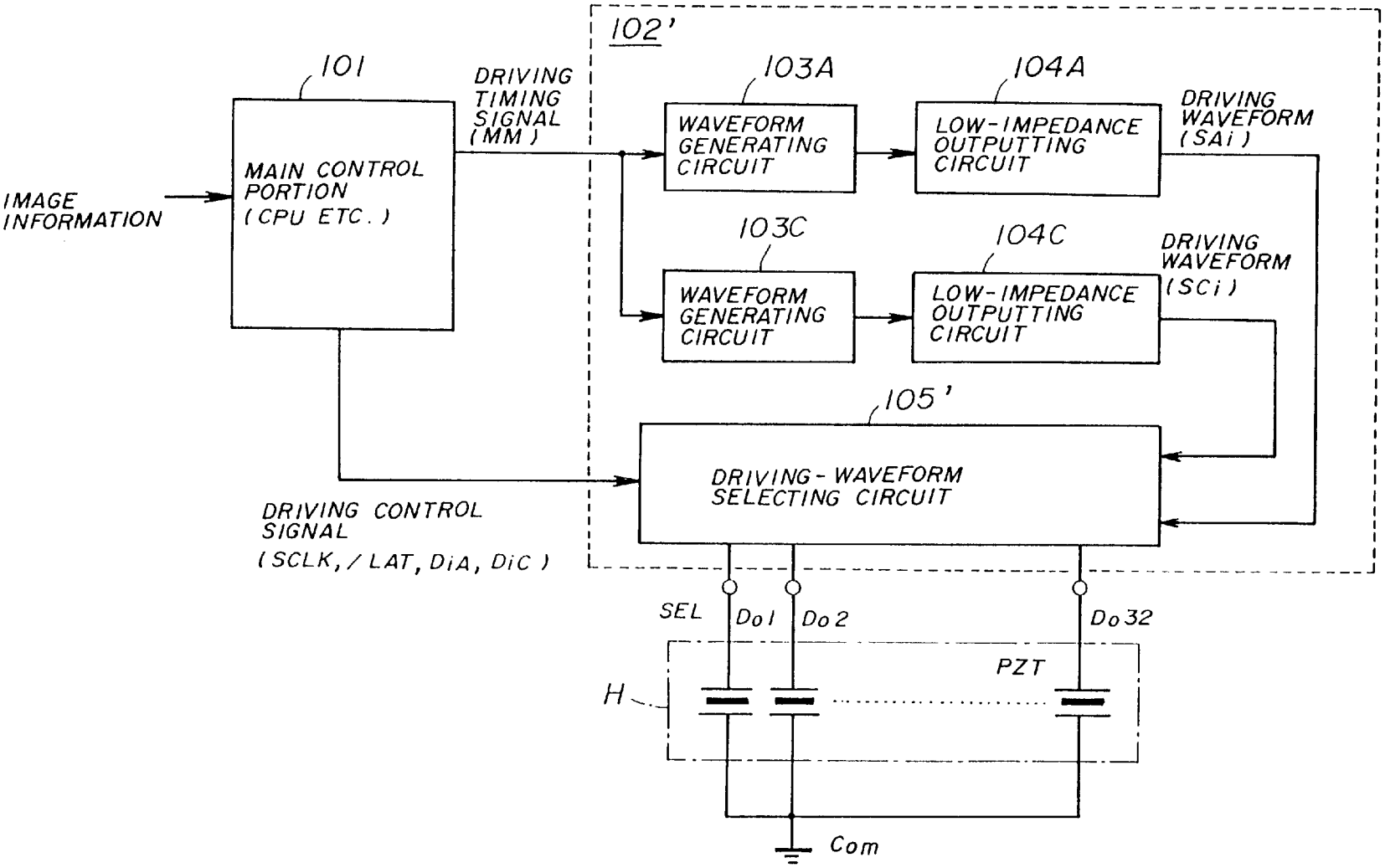
FIG. 20 shows a block-diagram of a portion of the control portion, which concerns recording-head driving control, in a third embodiment of the present invention.

A third embodiment of the present invention will now be described. The third embodiment is the same as the above-described first embodiment except for the following points. With reference to FIG. 20, in the head driving portion 102', a waveform generating circuit 103C and a low-impedance outputting circuit 104C output a driving waveform SCi which applies such small power to the piezoelectric element PZT that, thereby, the piezoelectric element PZT generates energy to cause the nozzle to actually fire no ink drop. However, the circuit arrangements of the waveform generating circuit 103C and the low-impedance outputting circuit 104C are the same as those of the waveform generating circuit 103A and the low-impedance outputting circuit 104A which output the driving waveform SAi which applies such large power to the piezoelectric element PZT that, thereby, the piezoelectric element PZT generates energy to cause the nozzle to fire an ink drop.

In other words, the difference between the first and third embodiments is as follows. In the first embodiment, the head driving portion 102 generates the two driving waveforms SAi and SBi, each of which applies such power to the piezoelectric element PZT that, thereby, the piezoelectric element PZT generates energy to cause the nozzle to fire an ink drop so as to form a dot of a respective one of two different diameters on a recording medium, while, in the third embodiment, the head driving portion 102' generates the two driving waveforms SAi and SCi, one of which applies such large power to the piezoelectric element PZT that, thereby, the piezoelectric element PZT generates energy to cause the nozzle to fire an ink drop, and the other of which applies such small power to the piezoelectric element PZT that, thereby, the piezoelectric element PZT generates energy to cause the nozzle to fire no ink drop.

As described above, in an ink-jet recording apparatus which can be used as an image forming apparatus of a printer, a facsimile machine, a copier or the like, when a ink drop is caused to be fired from a certain nozzle (such a nozzle that is caused to fire an ink drop being referred to as a 'firing nozzle'), meniscuses in adjacent nozzles, which are not caused to fire ink drops, respectively (such a nozzle that is not caused to fire an ink drop being referred to as a 'non-firing nozzle'), are in unstable conditions as a result of being affected mechanically or affected by flowing of the ink in the ink-jet head as a result of the ink firing operation performed by the above-mentioned certain nozzle. Thereby, a speed (ink firing speed) Vj of ink fired from the nozzle of the ink-jet head and/or an amount (ink-firing amount) Mj of ink fired from the nozzle of the ink-jet head varies, when each of the adjacent nozzles is then caused to fire an ink drop, and also, a condition in which an ink drop is not fired sufficiently occurs as a result of bubbles being drawn into the nozzle and contained in the ink in the ink-jet head.

In order to eliminate such problems, in the third embodiment, when a certain nozzle is a firing nozzle, the piezoelectric elements PZTs of adjacent nozzles, which are non-firing nozzles, have the driving waveform SCi applied thereto. Such a nozzle that is driven, for example, by the driving waveform SCi, but is not caused to fire an ink drop, is referred to as a 'driven, non-firing nozzle'. Such a nozzle that is not driven and is not caused to fire an ink drop is referred to as a 'non-driven, non-firing nozzle'.

Figure 11:
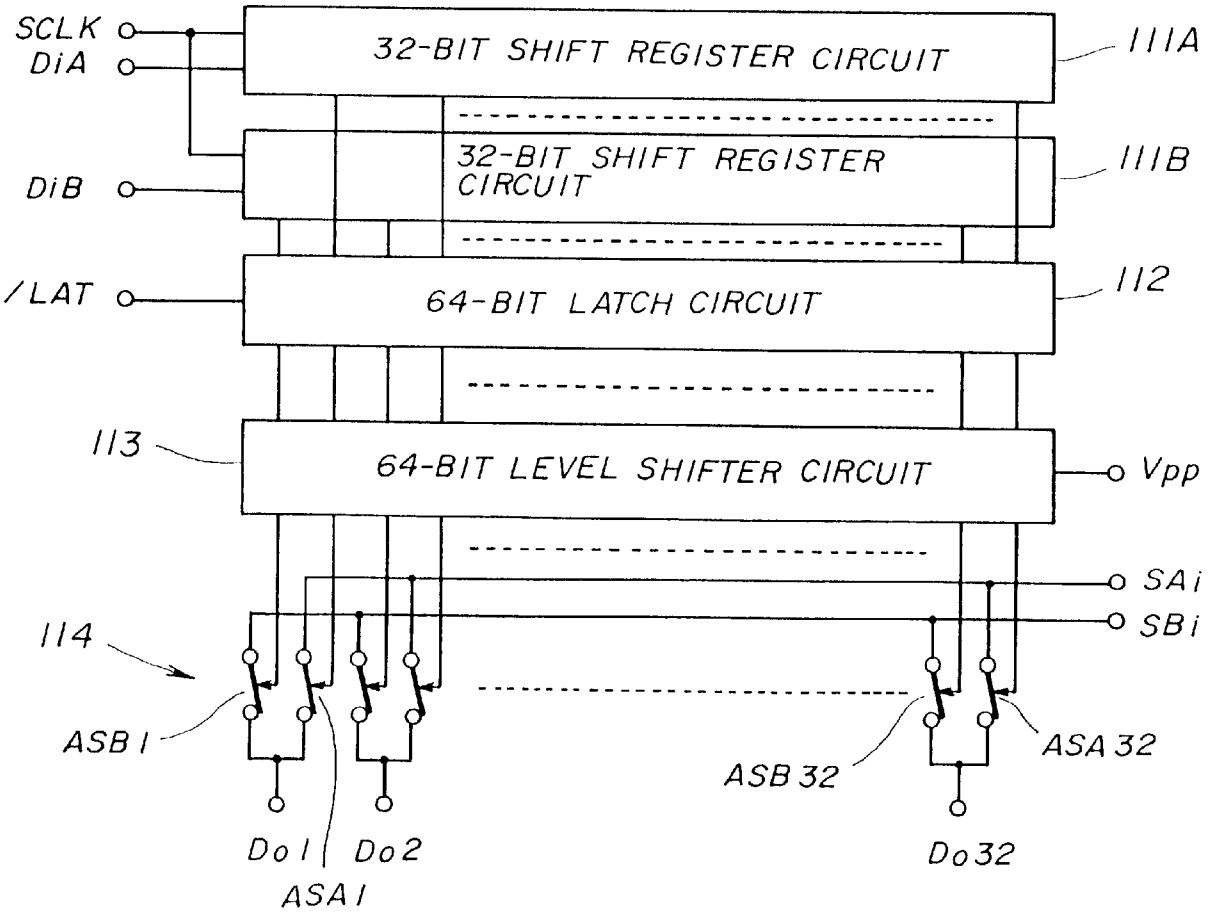
FIG. 11 shows a block diagram of one example of a driving-waveform selecting circuit shown in FIG. 7.
Figure 21:
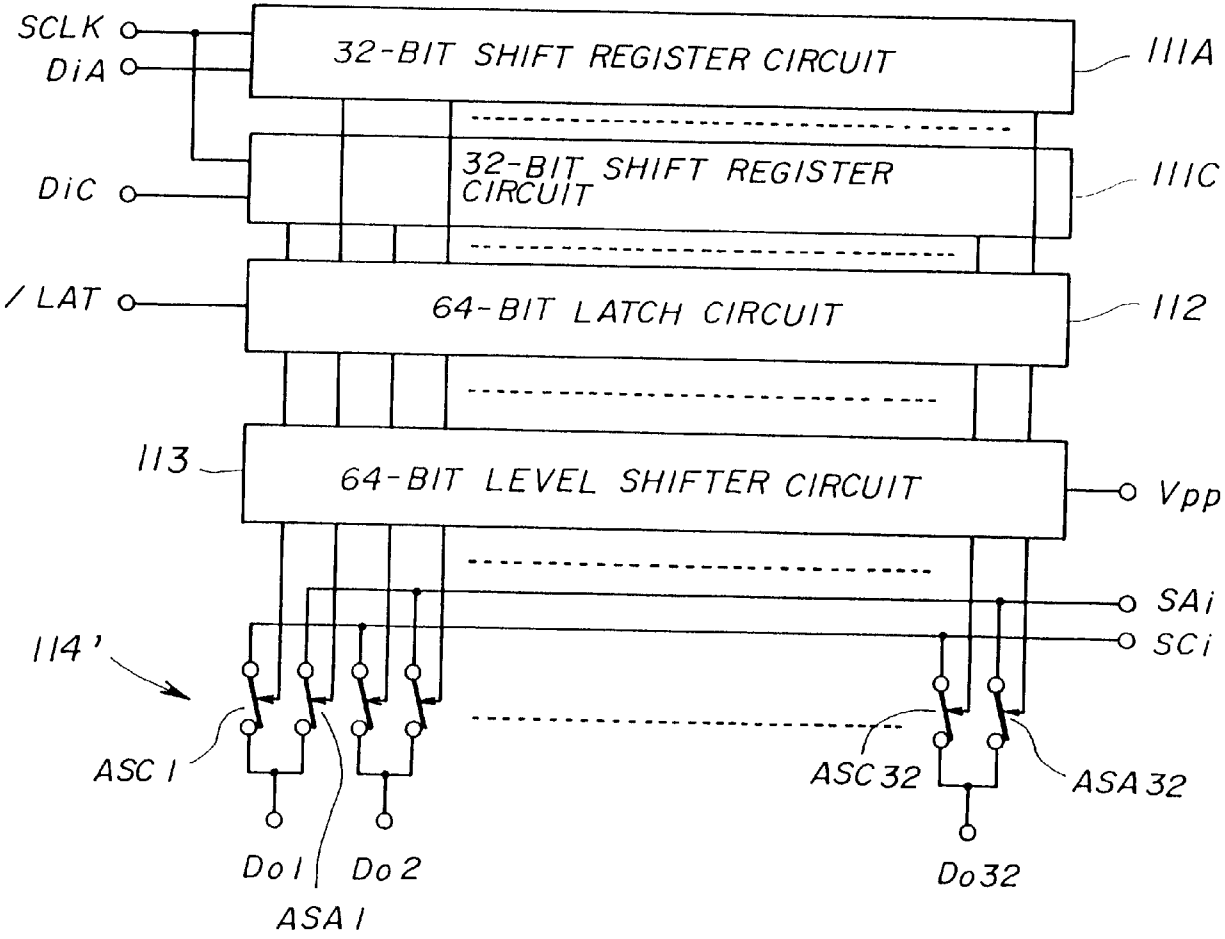
FIG. 21 shows a block diagram of one example of a driving-waveform selecting circuit shown in FIG. 20.

The driving-waveform selecting circuit 105' in the third embodiment, shown in FIG. 21, has the circuit arrangement the same as that of the driving-waveform selecting circuit 105 in the first embodiment shown in FIG. 11. However, instead of handling the driving waveforms SAi and SBi in the first embodiment, the driving-waveform selecting circuit 105' in the third embodiment handles the driving waveforms SAi and SCi. Further, instead of the serial data DiA and DiB for the driving waveforms SAi and SBi, respectively, being input to the driving-waveform selecting circuit 105 in the first embodiment, the serial data DiA for the driving waveform SAi and serial data DiC for the driving waveform SCi are input to the driving-waveform selecting circuit 105' in the third embodiment. The driving-waveform selecting circuit 105' in the third embodiment applies the driving waveform SAi, the driving waveform SCi, or no driving waveform to each one of the piezoelectric elements PZTs.

As shown in FIG. 21, the driving-waveform selecting circuit 105' includes two 32-bit shift register circuits 111A, 111C, to which the shift clock signal SCLK and serial data DiA, DiC are input, the 64-bit latch circuit 112 which latches the respective outputs of the shift registers 111A, 111C at the timing of the latch signal /LAT (where '/' means inverting), the 64-bit level shifter circuit 113, and a group of analog switches 114' which are controlled by the outputs of the level shifter circuit 113. The group of analog switches 114' includes pairs of analog switches, ASA1 and ASC1, ASA2 and ASC2, . . . , ASA32' and ASC32, which are connected to the selection terminals of the PZTs, Do1, Do2, . . . , Do32, respectively. The driving waveform SAi is input to the analog switches ASA1, ASA2, . . . , ASA32 while the driving waveform SCi is input to the analog switches ASC1, ASC2, . . . , ASC32.

The serial data DiA, DiC is taken by the shift resister circuits 111A, 111C at the timing of the shift clock signal SCLK, respectively, and the serial data DiA, DiC taken by the shift register circuits 111A, 111C are latched by the latch circuit 112 at the timing of the latch signal /LAT. The serial data DiA, DiC, thus latched by the latch circuit 112, is then input to the level shifter circuit 113 from the latch circuit 112.

The level shifter circuit 113, in accordance with the contents of the serial data DiA, DiC, turns on one of the pair of two analog switches ASAm and ASCm (m=1 through 32), connected to the respective one of the piezoelectric elements PZTs, and turns off the other of the pair of two analog switches, or turns off every one of the pair of two analog switches. Thereby, either one of the driving waveforms SAi, SCi is selected and is applied to the piezoelectric element PZT, or none of the driving waveforms is applied to the piezoelectric element PZT.

A driving control signal output from the main control portion 101 to the driving-waveform selecting circuit 105 includes the serial data DiA and DiC, and the timing signal (the shift clock signal SCLK and the latch signal /LAT), shown in FIGS. 22A, 22B, 22C and 22D. The serial data DiA is 32-bit firing-nozzle data which specifies firing nozzles. The serial data DiC is 32-bit driven, non-firing-nozzle data which specifies driven, non-firing nozzles.

Figures 22A, 22B, 22C, 22D, 22E, 22F, 22G, 22H, 22I, 22J:
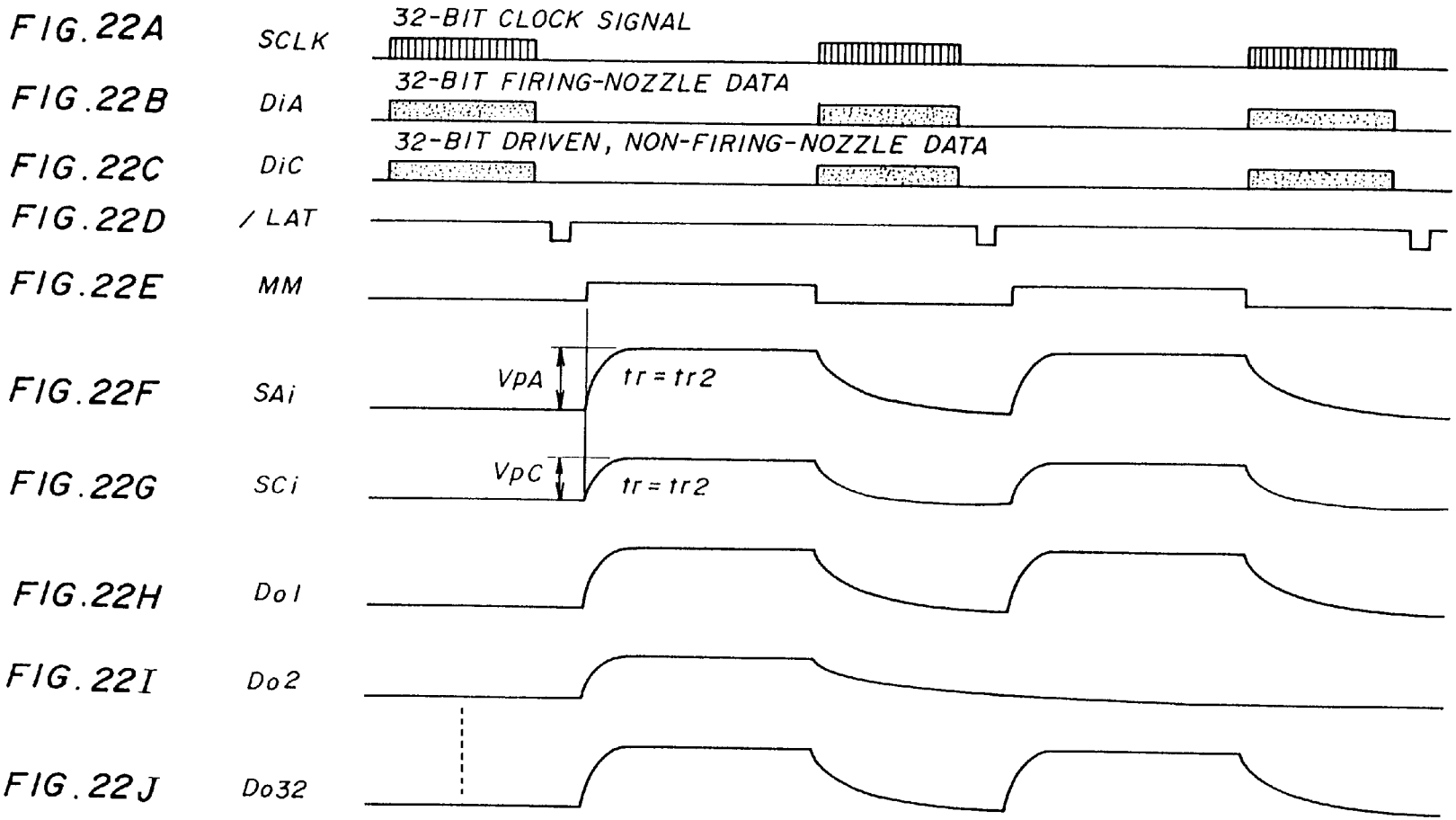
FIGS. 22A, 22B, 22C, 22D, 22E, 22F, 22G, 22H, 22I and 22J illustrate functions of the portion, of the control portion, which concerns recording-head driving control, shown in FIG. 20.

As shown in FIGS. 22F and 22G, the driving waveform SAi has a maximum driving voltage Vp=VpA and a rising time constant tr=tr2, while the driving waveform SCi has a maximum driving voltage Vp=VpC and a rising time constant tr=tr2, where VpC<VpA. As a result, the maximum driving voltage of 0, VpC or VpA is applied to each of the selection terminals Do1, Do2, . . . , Do32, as shown in FIGS. 22H, 22I and 22J, that is to each piezoelectric element PZT. That is, the driving waveform SAi of the maximum driving voltage of VpA is applied to firing nozzles, the driving waveform SCi of the maximum driving voltage of VpC is applied to driven, non-firing nozzles, and 0 (V) is applied non-driven, non-firing nozzles. For example, the maximum driving voltage VpA is applied to the selection terminal Do1 first, and then, the maximum driving voltage VpA is applied to the selection terminal Do1 again, as shown in FIG. 22H. Similarly, the maximum driving voltage VpA is applied to the selection terminal Do32 first, and then, the maximum driving voltage VpA is applied to the selection terminal Do32 again, as shown in FIG. 22J. On the other hand, the maximum driving voltage VpC is applied to the selection terminal Do2 first, and then, the maximum driving voltage 0 is applied to the selection terminal Do2, as shown in FIG. 221.

Figures 23A, 23B, 23C:
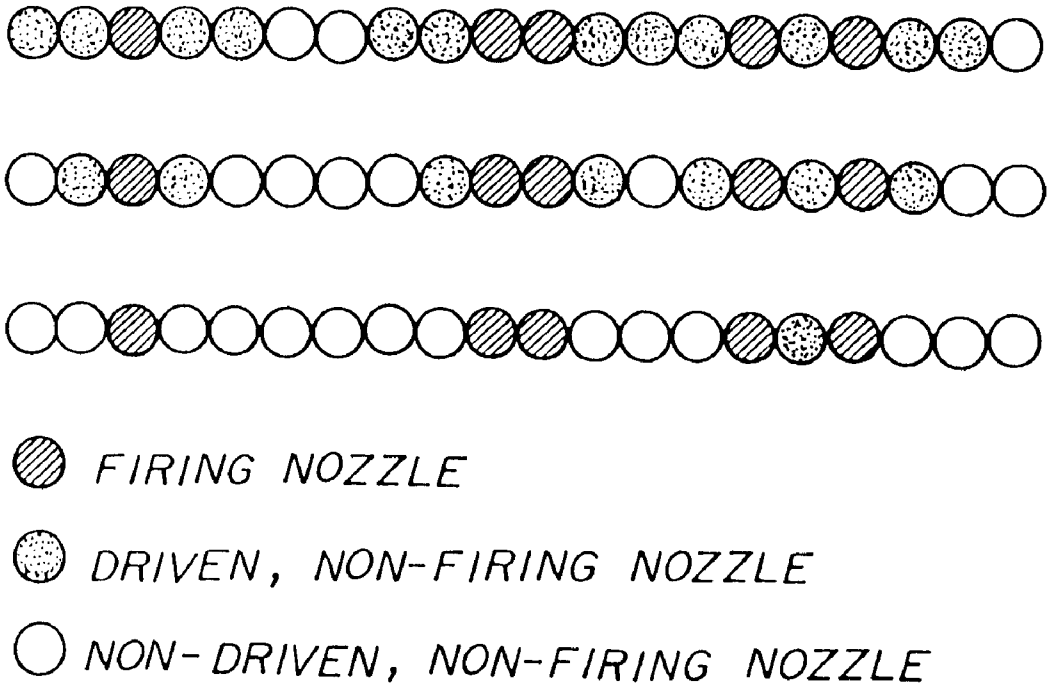
FIGS. 23A, 23B and 23C illustrate patterns of driving nozzles in the third embodiment of the present invention.

Driven, non-firing nozzles are set arbitrarily in accordance with image information. For example, adjacent two nozzles of either side of each firing nozzle may be driven, non-firing nozzles as shown in FIG. 23A, adjacent one nozzle of either side of each firing nozzle may be a driven, non-firing nozzle as shown in FIG. 23B, and only a nozzle present immediately between two firing nozzle may be a driven, non-firing nozzle as shown in FIG. 23C.

It is possible to set a plurality of such patterns for determining driven, non-firing nozzles. The thus-set plurality of patterns are previously stored in the ROM 81 of the main control portion 101, and the driven, non-firing-nozzle data DiC is produced as a result of comparing the stored patterns with the firing-nozzle data DiA. Thus, it is possible to determine driven, non-firing nozzles in an appropriate pattern. It is also possible to produce a pattern of driven, non-firing nozzles from performing a logical operation so as to obtain a logical sum or a logical product of firing nozzles. For example, a No.11 nozzle is driven, non-firing nozzle, when every one of a No.10 nozzle and a No.12 nozzles is a firing nozzle.

This method is a method using a logical sum operation. For example, a No.11 nozzle is driven, non-firing nozzle, when any one of a No.10 nozzle and a No.12 nozzles is a firing nozzle. This method is a method using a logical product operation.

Thus, as a result of generating a plurality of (two, in the above-described first embodiment) driving waveforms including a driving waveform for causing nozzles to fire no ink drops, selecting one of the plurality of waveforms in accordance with image information, and applying the selected waveform to a respective one of the energy generating elements (piezoelectric element PZT, in the above-described embodiment), it is possible to apply the driving waveform, for causing nozzles to fire no ink drops, to energy generating elements of driven, non-firing nozzles. Thereby, it is possible to cause the nozzles to fire ink drops stably, and thus, a high-quality image can be obtained.

Further, in this case, the image information is converted into the nozzle data (nozzle selection data) which is the serial data for a plurality of driving waveforms, respectively. The serial data includes at least the serial data which is driven, non-firing-nozzle data and specifies driven, non-firing nozzles to which such a driving waveform that causes the nozzles to fire no ink drops is applied. As a result, when the driving-waveform selecting circuit is formed to be an IC which is to be loaded in the ink jet head, it is not necessary to specially provide an image information processing portion, and merely a simple circuit arrangement of the driving waveform selecting circuit should be provided. In the circuit arrangement, the number of signal lines for the serial data does not increase when the number of nozzles increases.

Further, the driven, non-firing-nozzle data is produced based on image information, and it is possible to use any pattern for determining driven, non-firing nozzles. Therefore, it is possible to appropriately change the pattern in accordance with the head structure and/or the environment in which the ink-jet recording apparatus is used.

A fourth embodiment of the present invention will now be described. The fourth embodiment is the same as the third embodiment except for the following points. In the fourth embodiment, in the head driving portion 102' of the head driving control portion, the driving-waveform generating portion 106 and the low-impedance outputting circuit 104A in the third embodiment for the driving waveform SAi are replaced by the driving-waveform generating portion and the low-impedance outputting circuit shown in FIG. 24. Similarly, the driving-waveform generating portion 106 and the low-impedance outputting circuit 104C in the third embodiment for the driving waveform SCi are replaced by the driving-waveform generating portion and the low-impedance outputting circuit shown in FIG. 24.

Figure 24:
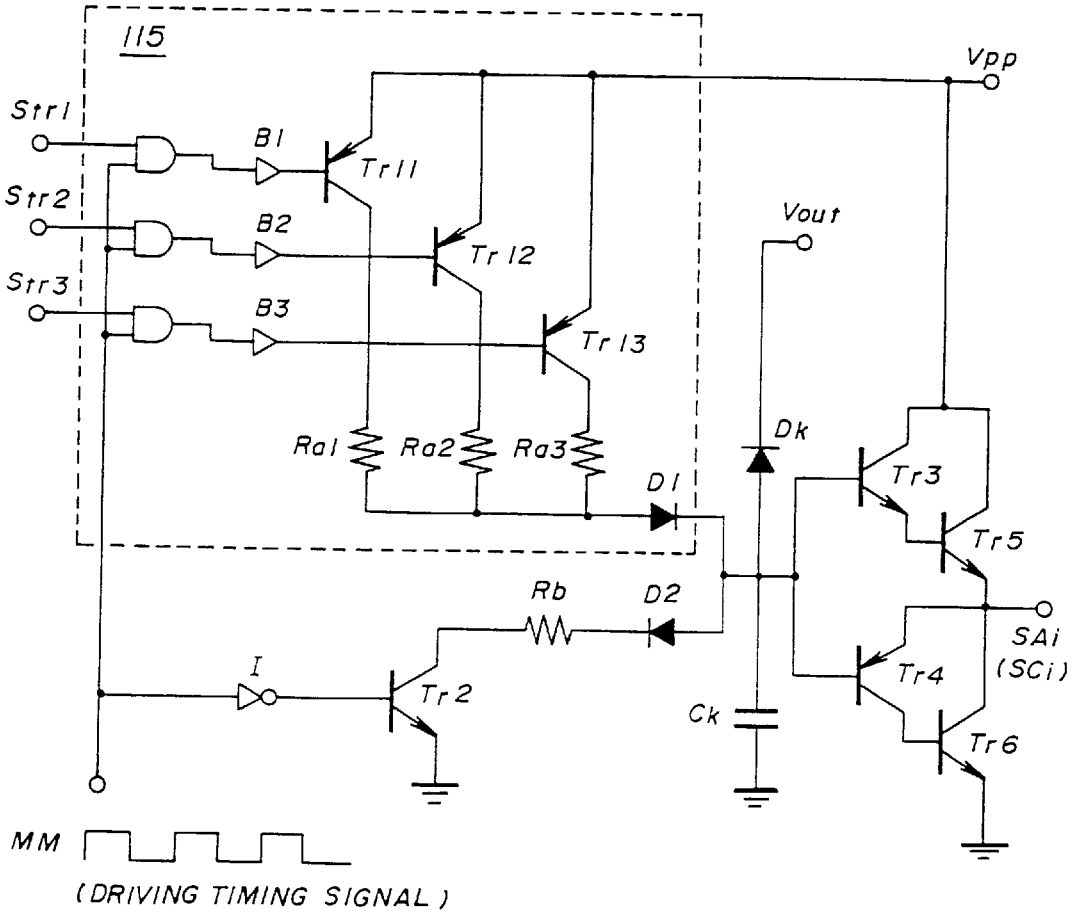
FIG. 24 shows a circuit diagram of one example of a driving waveform generating portion and a low-impedance outputting circuit, in a fourth embodiment of the present invention.

The driving-waveform generating portion and the low-impedance outputting circuit in the fourth embodiment shown in FIG. 24 include the tr control circuit 115 which changes the rising time constant tr as a result of the charging resistor Ra which is connected with the diode D1 in series being changed.

In the tr control circuit, as shown in FIG. 24, a parallel circuit of charging resistors Ra1, Ra2 and Ra3 is connected with the diode D1 in series. Switching transistors Tr11, Tr12 and Tr13 are connected between the charging resistors Ra1, Ra2 and Ra3, and the power source voltage Vpp, respectively. Buffers B1, B2 and B3 are connected with the bases of the transistors Tr11, Tr12 and Tr13, respectively, and, the driving timing signal MM is input to the buffers B1, B2 and B3 via gate circuits G1, G2 and G3, respectively. The gate circuits G1, G2 and G3 enter open states when tr control signals Str1, Str2 and Str3 from the main control portion 101 are in an 'H' level so as to output the driving timing signal MM to the buffers B1, B2 and B3, respectively.

Accordingly, when the main control portion 101 causes the driving timing signal MM to be in the 'H' level and also causes any one of the tr control signals Str1, Str2 and Str3 to be in the 'H' level, the one of the buffers B1, B2 and B3 selected by the one of the tr control signals Str1, Str2 and Str3 outputs the voltage level lower than the power source voltage Vpp. As a result, the corresponding one of the transistors Tr11, Tr12 or Tr13 is turned on, and, the capacitor Ck is charged at the time constant determined by the capacitance of the capacitor Ck and the thus-selected one of the charging resistors Ra1, Ra2 and Ra3.

Thus, by the tr control signals, the capacitor Ck can be charged in one of a maximum of seven rising time constants tr. It is possible to select, generate and output one of three driving waveforms having the rising time constants tr1, tr2 and tr3, respectively.

It is possible to fix the voltage Vout which determines the maximum driving voltage Vp. However, in this case, using the Vp control circuit 107 shown in FIG. 10, the driving waveforms which have different rising time constants and different maximum driving voltages are generated and output.

Thus, as a result of generating and outputting the driving waveforms having the different maximum driving voltages Vp and the different rising time constants tr as the driving waveforms SAi and SCi output from the head driving portion 102', and selecting these driving waveforms through the driving-waveform selecting circuit 105 similarly to the case * of the third embodiment, ink is fired in the stable range of the ink firing speed Vj, and dots having different diameters are formed, and thus, a multi-tone image is formed. Further, when variations in the ink firing amount Mj and the ink firing speed Vj are to be corrected, as a result of combinations of the driving voltages Vp and the rising time constants tr being appropriately selected, a high-quality image can be obtained.

Further, in accordance with the head structure and/or energy generating elements (electromechanical transducing elements or electrothermal transducing elements) to be used, the maximum driving voltage Vp, the rising time constant tr, a decaying time constant tf and a pulse width Pw, shown in FIG. 18, are controlled so that the ink firing amount Mj and the ink firing speed Vj are controlled, and thus, dots having different diameters can be formed, and appropriate waveforms for causing nozzles to fire no ink drops can be set.

For example, when the piezoelectric element are used as the energy generating element, and an ink drop is fired at the time of decaying in the driving waveform, such as in a case where a transformation in the d31 direction of the piezoelectric element is used, the decaying time constant tf is controlled instead of the rising time constant.

The arrangement of the head driving portion and the driving waveforms are not limited to those described above. Any other arrangement of the head driving portion and driving waveforms can be used as long as an ink drop is stably fired. As the driving waveform, a triangle waveform, a sine waveform, or the like can be used. Further, as the plurality of different driving waveforms, it is also possible to use three or more different waveforms, instead of two different waveforms SAi, SCi as described above.

Figure 25:
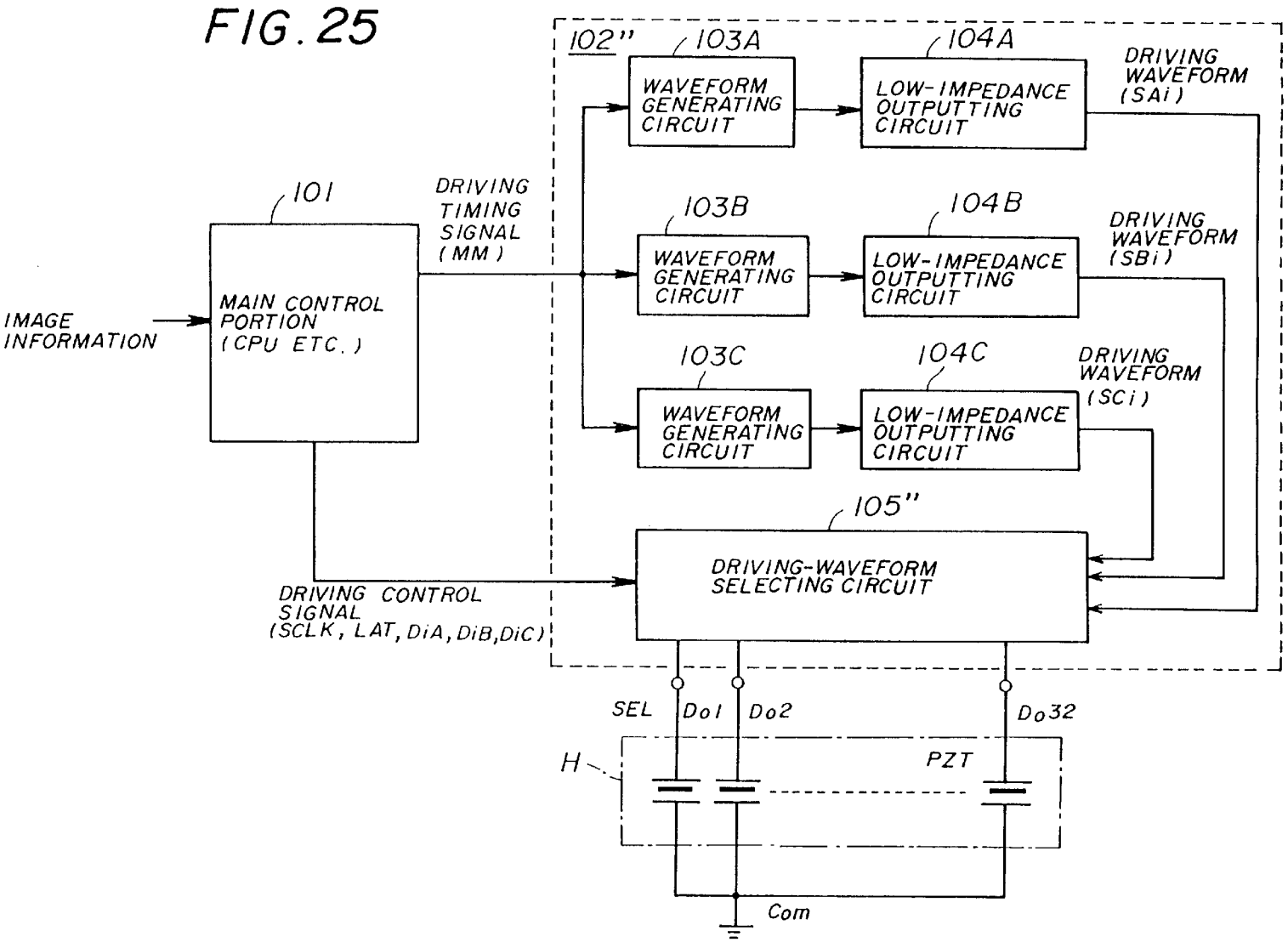
FIG. 25 shows a block diagram of a portion of the control portion, which concerns recording-head driving control, in a combination of the first and third embodiments of the present invention.
Figure 26:
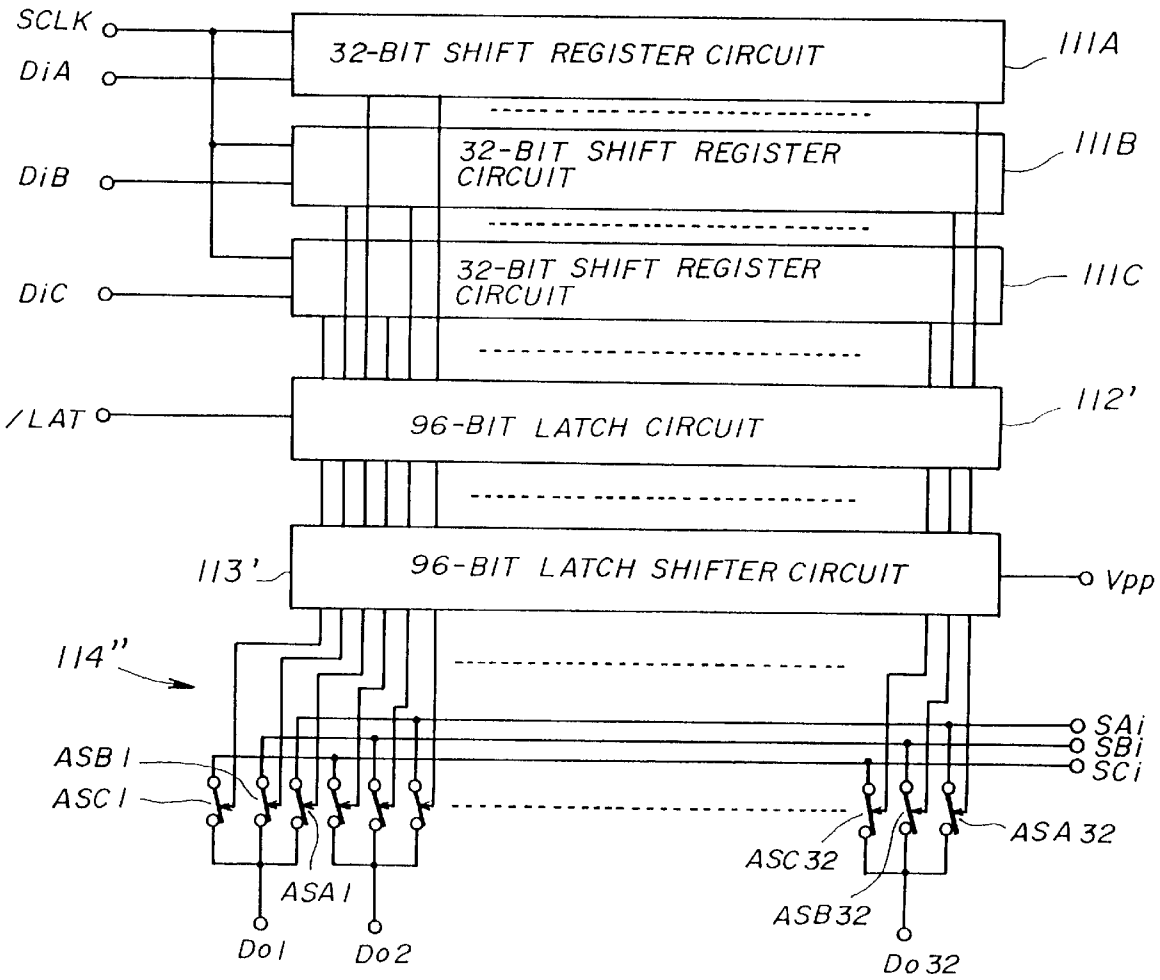
FIG. 26 shows a block diagram of one example of a driving-waveform selecting circuit shown in FIG. 25.

Further, it is possible to combine the first and third embodiments. Specifically, as shown in FIG. 25, a head driving portion 102" includes the waveform generating circuit 103A and the low-impedance outputting circuit 104A which output the driving waveform SAi which applies such large power to the piezoelectric element PZT that, thereby, the piezoelectric element PZT generates energy to cause the nozzle to fire a large ink drop, the waveform generating circuit 103B and the low-impedance outputting circuit 104B which output the driving waveform SBi which applies such medium power to the piezoelectric element PZT that, thereby, the piezoelectric element PZT generates energy to cause the nozzle to fire a small ink drop, and the waveform generating circuit 103C and the low-impedance outputting circuit 104C which output the driving waveform SCi which applies such small power to the piezoelectric element PZT that, thereby, the piezoelectric element PZT generates energy to cause the nozzle to fire no ink drop.

To a driving-waveform selecting circuit 105", the 32-bit firing-nozzle data DiA for selecting firing nozzles to fire large ink drops, respectively, the 32-bit firing-nozzle data DiB for selecting firing nozzles to fire small ink drops, respectively, and 32-bit driven, non-firing-nozzle data DiC for selecting driven, non-firing nozzles to fire no ink drops, respectively, are input. The driving-waveform selecting circuit 105" includes the 32-bit shift register circuit 111A to which the 32-bit firing-nozzle data DiA and the shift clock signal SCLK are input, the 32-bit shift register circuit 111B to which the 32-bit firing-nozzle data DiB and the shift clock signal SCLK are input, the 32-bit shift register circuit 111C to which the 32-bit driven, non-firing-nozzle data DiC and the shift clock signal SCLK are input.

The driving-waveform selecting circuit 105" further includes a 96-bit latch circuit which latches the respective outputs of the shift registers 111A, 111B, 111C at the timing of the latch signal /LAT (where '/' means inverting), a 96-bit level shifter circuit 113', and a group of analog switches 114" which are controlled by the outputs of the 96-bit level shifter circuit 113'.

The group of analog switches 114" includes sets of analog switches, ASA1, ASB1 and ASC1, ASA2, ASB2 and ASC2, . . . , ASA32, ASB32 and ASC32, which are connected to the selection terminals of the PZTs, Do1, Do2, . . . , Do32, respectively. The driving waveform SAi is input to the analog switches ASA1, ASA2, . . . , ASA32, the driving waveform SBi is input to the analog switches ASB1, ASB2, . . . , ASB32, and the driving waveform SCi is input to the analog switches ASC1, ASC2, . . . , ASC32.

The serial data DiA, DiB, DiC is taken by the shift resister circuits 111A, 111B, 111C at the timing of the shift clock signal SCLK, respectively, and the serial data DiA, DIB, DiC taken by the shift register circuits 111A, 111B, 111C are latched by the latch circuit 112' at the timing of the latch signal /LAT. The serial data DiA, DiB, DiC, thus latched by the latch circuit 112', is then input to the level shifter circuit 113' from the latch circuit 112'.

The level shifter circuit 113', in accordance with the contents of the serial data DiA, DiB, DiC, turns on one of the set of three analog switches ASAm, ASBm and ASCm (m=1 through 32), connected to the respective one of the piezoelectric elements PZTs, and turns off the others of the set of three analog switches, or turns off every one of the set of three analog switches. Thereby, any one of the driving waveforms SAi, SBi, SCi is selected and is applied to the piezoelectric element PZT, or none of mF. the driving waveforms is applied to the piezoelectric element PZT.

The driving waveform SAi has the maximum driving voltage Vp=VpA and the rising time constant tr=tr2, the driving waveform SBi has the maximum driving voltage Vp=VpB and the rising time constant tr=tr2, and the driving waveform SCi has the maximum driving voltage Vp=VpC and the rising time constant tr=tr2, where VpC<VpB<VpA. As a result, the maximum driving voltage of 0, VpC, VpB or VpA is applied to each of the selection terminals Do1, Do2, . . . , Do32, that is, to each piezoelectric element PZT. That is, the driving waveform SAi of the maximum driving voltage of VpA is applied to piezoelectric elements PZTs of firing nozzles for forming large dots, the driving waveform SBi of the maximum driving voltage of VpB is applied to piezoelectric elements PZTs of firing nozzles for forming small dots, the driving waveform SCi of the maximum driving voltage of VpC is applied to piezoelectric elements PZTs of driven, non-firing nozzles, and 0 (V) is applied to piezoelectric elements PZTs of non-driven, non-firing nozzles.

Thereby, it is possible to form dots of different diameters, and also, it is possible to keep a stable ink firing condition.

Further, the present invention is not limited to the above-described embodiments, and variations and modifications may be made without departing from the scope of the present invention.

The contents of the basic Japanese Patent Application No.9-195337, filed on Jul. 22, 1997, No.9-195338, filed on Jul. 22, 1997, and No.10-135808, filed on May 19, 1998 are hereby incorporated by reference.

What is claimed is:

1. An ink-jet recording apparatus comprising:

a plurality of nozzles for firing ink drops;

a plurality of pressure-application ink chambers, communicating with said plurality of nozzles, respectively;

a plurality of energy generating elements for generating energy for applying pressure to ink in the plurality of pressure-application ink chambers that fires the ink drops from said plurality of nozzles, respectively;

driving-waveform generating means for generating a plurality of different driving waveforms for driving said plurality of energy generating elements, wherein each of the plurality of driving waveforms has a maximum driving voltage and a rise time and wherein the higher the maximum driving voltage the longer the rise time; and driving-waveform selecting means for selecting one of the plurality of driving waveforms generated by said driving-waveform generating means for each one of said plurality of energy generating elements in accordance with image information.

2. The ink-jet recording apparatus, according to claim 1, wherein the image information is converted into serial nozzle data for selecting nozzles driven for each of the plurality of driving waveforms, and the serial nozzle data is input to said driving-waveform selecting means.

3. The ink-jet recording apparatus, according to claim 2, wherein the serial nozzle data comprises a number of serial nozzle data, the number being equal to or less than the number of the plurality of driving waveforms.

4. The ink-jet recording apparatus, according to claim 1, wherein the plurality of driving waveforms are each different, with each waveform having, at least one of a maximum driving voltage, a time constant and a pulse width which is different from each other.

5. An ink-jet recording apparatus, comprising:

a plurality of nozzles for firing ink drops;

a plurality of pressure-application ink chambers, communicating with said plurality of nozzles, respectively;

a plurality of energy generating elements generating energy for applying pressure to ink in the plurality of pressure-application ink chambers that fires the ink drops from said plurality of nozzles, respectively;

a driving-waveform generating portion generating a plurality of driving waveforms for driving said plurality of energy generating elements, wherein each of the plurality of driving waveforms has a maximum driving voltage and a rise time and wherein the higher the maximum driving voltage the longer the rise time; and a driving-waveform selecting portion selecting one of the plurality of driving waveforms generated by said driving-waveform generating portion for each one of said plurality of energy generating elements in accordance with image information.

6. The ink-jet recording apparatus, according to claim 5, wherein the image information is converted into serial nozzle data for selecting nozzles driven for each of the plurality of driving waveforms, and the serial nozzle data is input to said driving-waveform selecting portion.

7. The ink-jet recording apparatus, according to claim 6, wherein the serial nozzle data comprises a number of serial nozzle data, the number being equal to or less than the number of the plurality of driving waveforms.

8. The ink-jet recording apparatus, according to claim 5, wherein the plurality of driving waveforms are each different, with each waveform having, at least one of a maximum driving voltage, a time constant and a pulse width which is different from each other.

9. An ink-jet recording apparatus, comprising:

a plurality of nozzles for firing ink drops;

a plurality of pressure-application ink chambers, communicating with said plurality of nozzles respectively;

a plurality of energy generating elements for generating energy for applying pressure to ink in the plurality of pressure-application ink chambers that fires the ink drops from said plurality of nozzles, respectively; and driving-waveform generating means for generating a plurality of driving waveforms for driving said plurality of energy generating elements, the plurality of driving waveforms including a driving waveform for causing nozzles of said plurality of nozzles to fire ink drops and a driving waveform for causing nozzles of said plurality of nozzles to fire no ink drops, wherein each of the plurality of driving waveforms has a maximum driving voltage and a rise time and wherein the higher the maximum driving voltage the longer the rise time; and driving-waveform selecting means for selecting one of the plurality of driving waveforms generated by said driving-waveform generating means for each one of said plurality of energy generating elements in accordance with image information.

10. The ink-jet recording apparatus, according to claim 9, wherein the image information is converted into serial nozzle data for selecting nozzles driven for each of the plurality of driving waveforms, and the serial nozzle data is input to said driving-waveform selecting means.

11. The ink-jet recording apparatus, according to claim 10, wherein the serial nozzle data comprises a number of serial nozzle data, the number being equal to or less than the number of the plurality of driving waveforms, and the number of serial nozzle data including the serial nozzle data for selecting nozzles of said plurality of nozzles driven by a driving waveform that does not cause the nozzles to fire ink drops.

12. The ink-jet recording apparatus, according to claim 9, wherein the plurality of driving waveforms including the driving waveforms for causing nozzles of said plurality of nozzles to fire ink drops and for causing nozzles of said plurality of nozzles to fire no ink drops, are each different, with each waveform having, at least one of a maximum driving voltage, a time constant and a pulse width which is different from each other.

13. An ink-jet recording apparatus, comprising:

a plurality of nozzles for firing ink drops;

a plurality of pressure-application ink chambers, communicating with said plurality of nozzles, respectively;

a plurality of energy generating elements generating energy for applying pressure to ink in the plurality of pressure-application ink chambers that fires the ink drops from said plurality of nozzles, respectively; and a driving-waveform generating portion generating a plurality of driving waveforms for driving said plurality of energy generating elements, the plurality of driving waveforms including a driving waveform for causing nozzles of said plurality of nozzles to fire ink drops and a driving waveform for causing nozzles of said plurality of nozzles to fire no ink drops, wherein each of the plurality of driving waveforms has a maximum driving voltage and a rise time and wherein the higher the maximum driving voltage the longer the rise time; and a driving-waveform selecting portion selecting one of the plurality of driving waveforms generated by said driving-waveform generating portion for each one of said plurality of energy generating elements in accordance with image information.

14. The inkjet recording apparatus, according to claim 13, wherein the image information is converted into serial nozzle data for selecting nozzles driven for each of the plurality of driving waveforms, and the serial nozzle data is input to said driving-waveform selecting portion.

15. The ink-jet recording apparatus, according to claim 14, wherein the serial nozzle data comprises a number of serial nozzle data, the number being equal to or less than the number of the plurality of driving waveforms, and the number of serial nozzle data including the serial nozzle data for selecting nozzles of said plurality of nozzles driven by the driving waveform but to fire no ink drops.

16. The ink-jet recording apparatus, according to claim 13, wherein the plurality of driving waveforms including the driving waveforms for causing nozzles of said plurality of nozzles to fire ink drops and for causing nozzles of said plurality of nozzles to fire no ink drops, are each different, with each waveform having, at least one of a maximum driving voltage, a time constant and a pulse width which is different from each other.

* * * * *